US005107943A

United States Patent [19]

McQueen et al.

[11] Patent Number: 5,107,943

[45] Date of Patent: Apr. 28, 1992

[54] METHOD AND APPARATUS FOR GRAVEL PACKING OF WELLS

[75] Inventors: Robert W. McQueen, Houston; Alan D. Peters, Midland; Charles D. Ebinger, Houston; Thomas A. Huddle, Katy, all of Tex.

[73] Assignee: Penetrators, Inc., Houston, Tex.

[21] Appl. No.: 597,046

[22] Filed: Oct. 15, 1990

[51] Int. Cl.[5] ..... E21B 29/02; E21B 43/114

[52] U.S. Cl. ..... 175/267; 175/286; 175/424; 166/55

[58] Field of Search ..... 175/267, 273, 286, 424; 166/55

[56] References Cited

U.S. PATENT DOCUMENTS

| | | | |
|---|---|---|---|
| Re. 29,021 | 11/1976 | Archibald et al. | 175/213 |
| 134,214 | 12/1872 | Mellor . | |
| 1,495,949 | 5/1924 | Carroll . | |
| 1,689,047 | 10/1928 | Packer . | |
| 2,018,285 | 10/1935 | Schweitzer et al. . | |
| 2,258,001 | 10/1941 | Chamberlain . | |
| 2,271,005 | 1/1942 | Grebe . | |
| 2,345,816 | 4/1944 | Hays . | |
| 2,426,106 | 8/1947 | Kinley . | |
| 2,457,277 | 12/1948 | Schlumberger . | |
| 2,539,047 | 1/1951 | Arutunoff . | |
| 2,580,146 | 12/1951 | Williams . | |
| 2,594,654 | 4/1952 | Jobe . | |
| 2,653,664 | 9/1953 | Dolby . | |
| 2,699,921 | 1/1955 | Garrison . | |
| 2,707,616 | 5/1955 | Schad et al. . | |
| 2,743,703 | 5/1956 | Miller . | |
| 2,758,653 | 8/1956 | Desbrow . | |
| 2,796,129 | 6/1957 | Brandon . | |
| 2,838,117 | 6/1958 | Clark et al. . | |
| 2,852,230 | 9/1958 | Garrison . | |
| 3,130,786 | 4/1964 | Brown et al. . | |
| 3,134,453 | 5/1964 | Cirami . | |
| 3,145,776 | 8/1964 | Pittman . | |
| 3,162,211 | 12/1964 | Barusch . | |
| 3,202,062 | 8/1965 | Burden . | |
| 3,221,824 | 12/1965 | Self . | |
| 3,301,337 | 1/1967 | Vaughn et al. . | |
| 3,318,395 | 5/1967 | Messmer . | |
| 3,370,887 | 2/1968 | Knutson et al. . | |
| 3,400,980 | 9/1968 | Dahms et al. . | |
| 3,402,965 | 9/1968 | Dahms et al. . | |
| 3,402,967 | 9/1968 | Edmonds . | |
| 3,511,133 | 5/1970 | Day . | |
| 3,547,191 | 12/1970 | Malott | 166/223 |
| 3,554,217 | 1/1971 | Ehrens et al. | 137/318 |
| 3,714,959 | 2/1973 | Pignatoro, Jr. | 137/318 |
| 3,720,262 | 3/1973 | Grable | 166/298 |
| 3,873,156 | 3/1975 | Jacoby | 299/4 |
| 3,916,998 | 11/1975 | Bass, Jr. et al. | 166/301 |
| 3,930,286 | 1/1976 | McGowen | 222/83 |
| 4,022,279 | 5/1977 | Driver | 166/271 |
| 4,050,529 | 9/1977 | Tagirov et al. | 175/422 |
| 4,134,453 | 1/1979 | Love et al. | 166/298 |
| 4,257,484 | 3/1981 | Whitley et al. | 166/325 |
| 4,298,757 | 5/1990 | Schellstede et al. | 166/55.1 |
| 4,317,492 | 3/1982 | Summers et al. | 175/79 |
| 4,346,761 | 8/1982 | Skinner et al. | 166/206 |
| 4,365,676 | 12/1982 | Boyadijieff et al. | 175/61 |
| 4,640,362 | 2/1987 | Schellstede | 166/298 |
| 4,790,384 | 12/1988 | Schellstede et al. | 166/298 |
| 4,889,197 | 12/1989 | Boe | 175/267 |
| 4,932,129 | 6/1990 | Schellstede et al. | 166/55 |

FOREIGN PATENT DOCUMENTS

| | | |
|---|---|---|
| 2824601 | 12/1979 | Fed. Rep. of Germany . |
| 2347524 | 4/1976 | France . |
| 720141 | 3/1980 | U.S.S.R. . |
| 883350 | 11/1981 | U.S.S.R. . |

*Primary Examiner*—Terry Lee Melius

*Attorney, Agent, or Firm*—Mason, Fenwick & Lawrence

[57] ABSTRACT

A well penetrator has a housing moveable down a well casing with a radially moveable punch being supported in the housing for movement between retracted and extended positions; a fluid jet is discharged from the outer end of the punch with liquid for the jet coming from a tube fixedly positioned at one end in the housing and held in slightly bowed condition when the punch is retracted to permit movement of the punch to its extended position from its retracted condition without the creation of excessive force on this metal tube. The jet creates a bulbous drumstick shaped cavity in the earth which is packed with a gravel slurry which hardens and cannot move into the casing due to the bulbous shape of the hardened slurry mass. Similar procedures are employed using a hose or lance with a nozzle at its outer end; one nozzle embodiment includes radial jets activated to transversely enlarge the cavity at a location spaced from the casing.

32 Claims, 19 Drawing Sheets

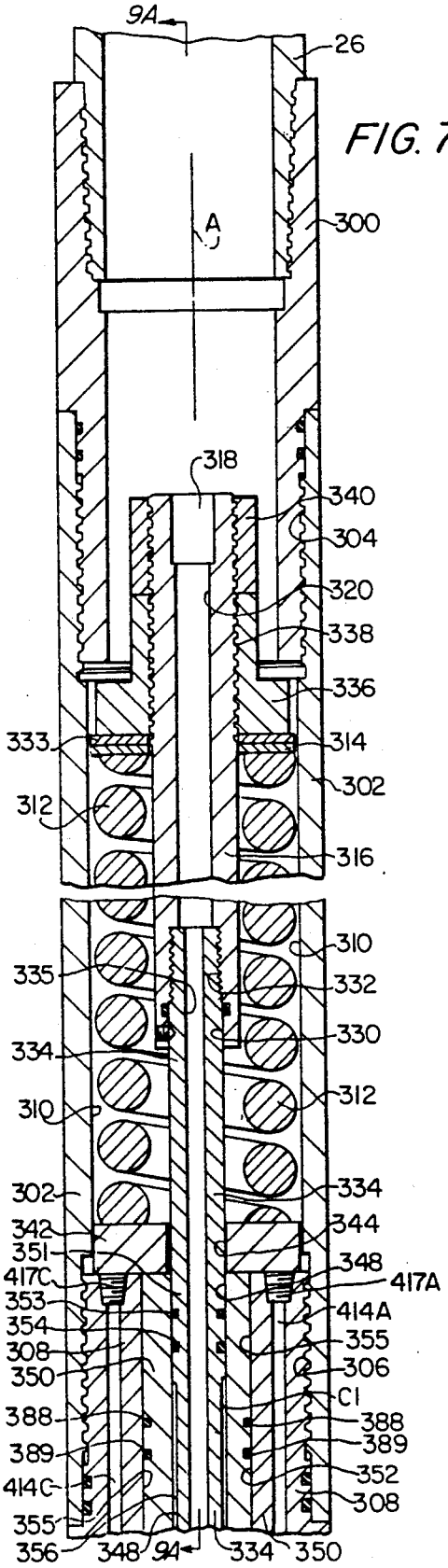
FIG. 7A
FIG. 7B
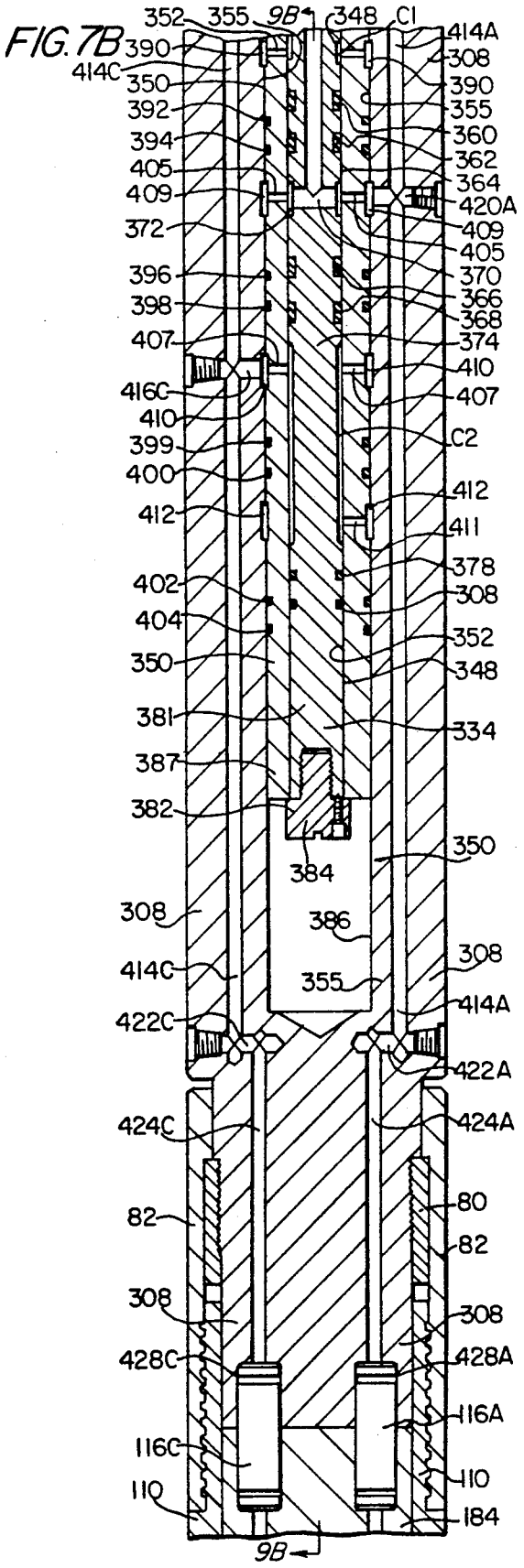

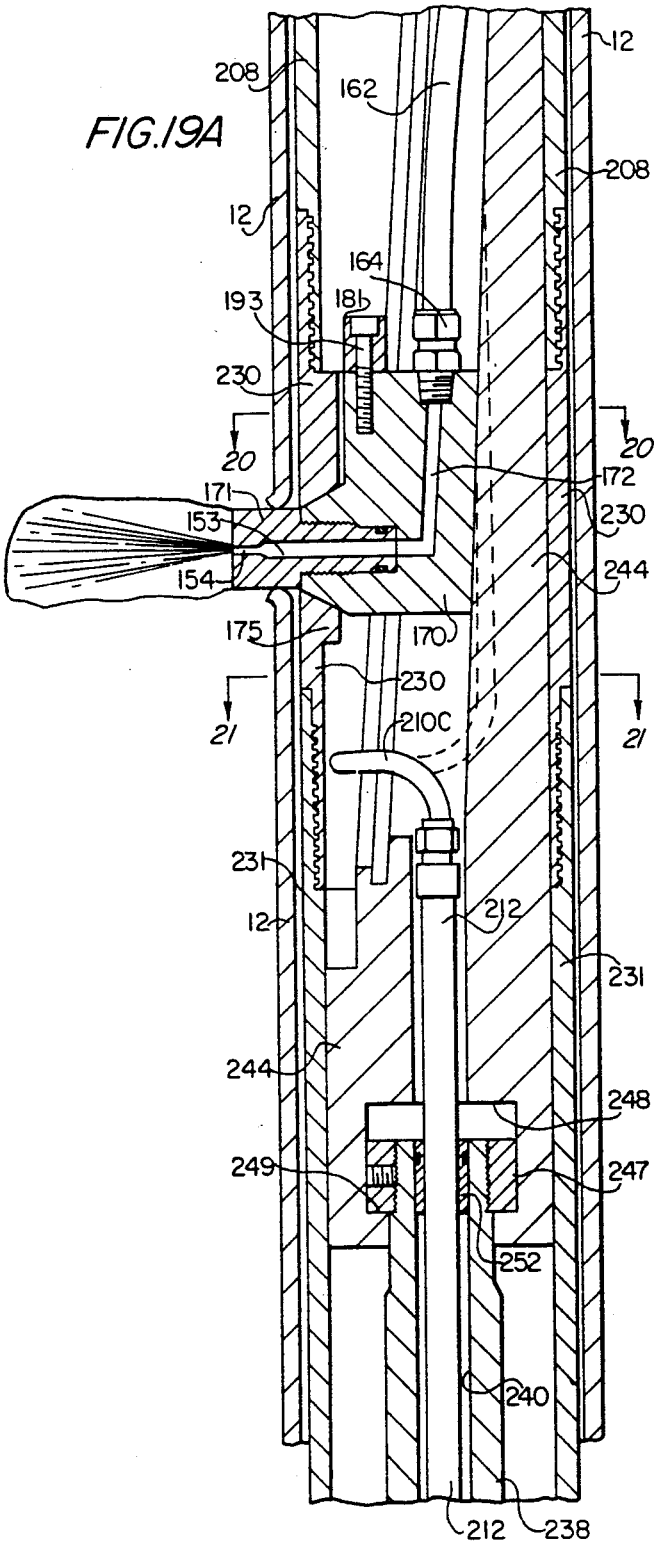
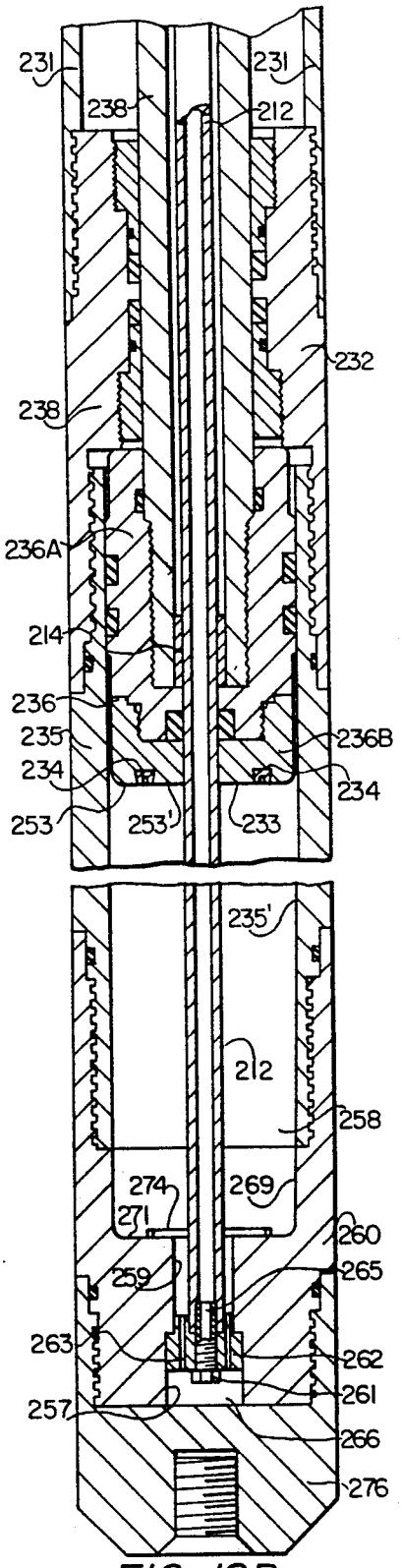
FIG. 19B

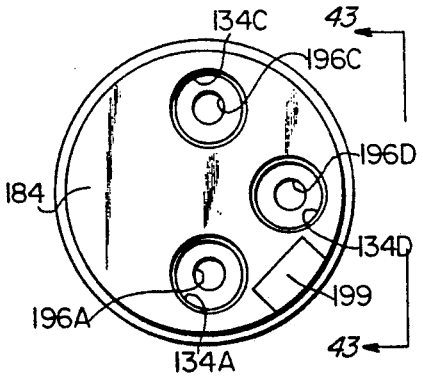
FIG. 42
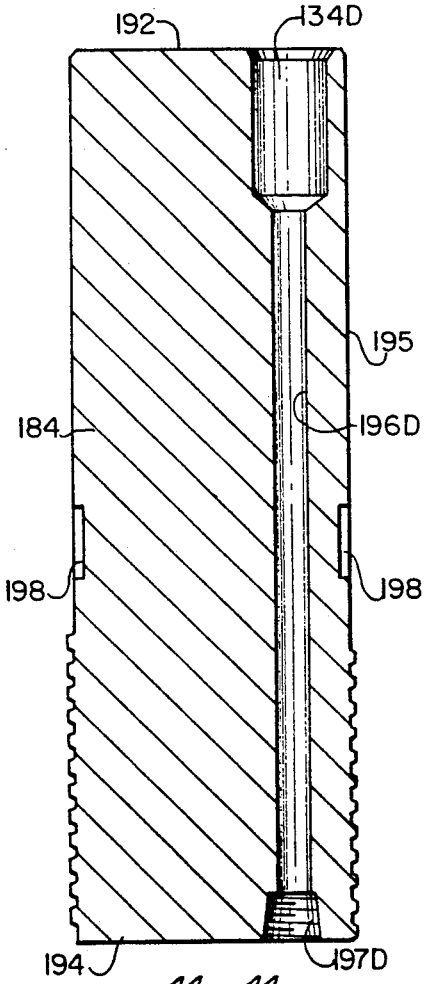
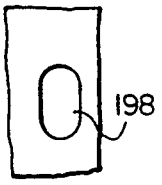
FIG. 44
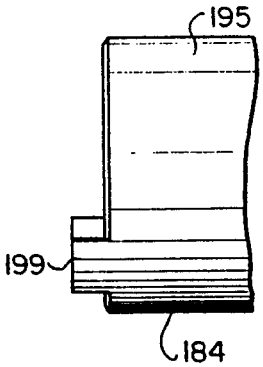
FIG. 43
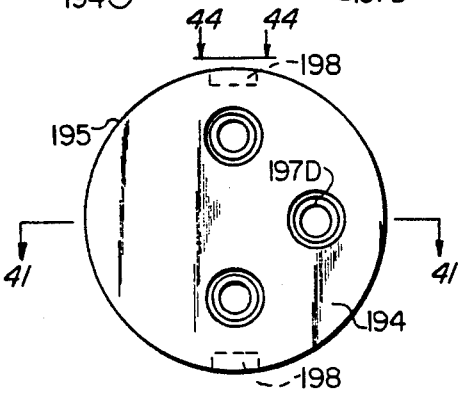
FIG. 40

METHOD AND APPARATUS FOR GRAVEL PACKING OF WELLS

BACKGROUND OF THE INVENTION

The present invention is in the field of oil and/or gas well gravel packing and related casing perforation apparatus, procedures and methods. More specifically, the present invention is directed to a unique gravel packing method and apparatus including unique casing punch means and associated drive means for cutting an opening in a well casing and subsequently cutting a cavity in the adjacent earth formation by the use of a high pressure jet effective a substantial distance outwardly beyond the casing to form a bulbous shaped cavity that has a large surface area and is larger in transverse dimension near its outer end spaced away from the casing than at its portion adjacent the casing. The cavity is then packed with a gravel slurry which soon hardens to provide a flowpath for gas and/or liquid flow into the casing. The subject invention represents a substantial advance over prior systems using explosive means or other means providing a cavity which is not bulbous and, in fact, usually tapers inwardly with increased distance from the casing so that only a narrow cavity having a small surface area is provided.

The vast majority of oil and gas wells are drilled by the use of rotary drilling procedures in which drilling mud containing extremely fine particles is forced downwardly through the drilling string and out through the bit for the removal of cuttings, cooling and other beneficial results. A commonly employed material in drilling mud comprises extremely small particles of barite. It has been found that the earth surrounding a drill bore is contaminated outwardly by the drilling fluid for a distance of a meter or more beyond the bore. This contamination, being largely formed of minute particles from the mud, frequently presents a substantial barrier to the inflow of hydrocarbons to the well casing.

Moreover, invasion of the formation by cementing and well completion fluids creates additional formation contamination. The zone around a well bore which has been contaminated or plugged by drilling fluid, cement or completion fluids is termed the invaded zone or damaged zone and the effect is called formation damage, skin damage or skin effect. "Skin effect" is a petroleum engineering measure of the extent of damage or resistance to flow of fluids around a well bore and is expressed as a dimensionless number. A high skin effect number or factor representing extensive formation damage for example would be fifty, whereas a low skin effect number would be zero.

A number of expedients have been proposed and employed in an effort to provide flow passageways through the surrounding strata or to remove skin effect for permitting and increasing the flow of hydrocarbons into the well casing. In many instances gravel packing is provided in the passageways in the formation in an effort to enhance production and reduce the inflow of fine particles into the casing; unfortunately, the effectiveness of the gravel packing is greatly reduced as a consequence of the shortcomings of the penetration devices and methods previously employed. These shortcomings include the inability to provide an opening extending beyond the zone of contamination surrounding the casing and the inability to provide a large opening capable of receiving a large quantity of gravel having a large surface area for production inflow. The gravel packing consequently frequently becomes clogged and production suffers a dramatic decline; moreover, the gravel packing is not secured against movement toward the casing and sometimes enters the openings in the casing so as to reduce or even prevent production.

Probably the most common expedient for effecting casing and formation penetration is the use of projectiles fired from gun-like devices positioned in the casing; however, the projectiles from such devices penetrate the casing but are normally incapable of penetrating beyond the zone of contamination; moreover, the formation openings formed by such devices and filled with gravel are tapered as shown at 18 in FIG. 22 and the gravel packing can frequently move back into the casing. Optimum flow conditions consequently cannot normally be achieved by the use of such projectile firing devices. Consequently, a variety of other procedures for penetrating the casing and surrounding strata have come forward.

For example, U.S. Pat. No. 4,022,279 proposed a method of boring spiral bores a substantial distance outwardly from a well-casing for increasing production. However, this patent does not disclose a specific apparatus for effecting the desired spiral bores and it is not certain that such structure actually exists. In any event, such spiral bores would be difficult or probably impossible to successfully fill with gravel packing.

U.S. Pat. No. 3,370,887 discloses the employment of high pressure nozzle means using a blowout plug 11 which is blown radially outwardly through the well casing by high pressure injected into the housing in which the plug is mounted.

U.S. Pat. Nos. 3,400,980 and 3,402,965 (both to Dahms et al.) both disclose a tool which is moved downwardly out the lower end of the well casing and from which extendible pipe or hose members move outwardly while discharging high pressure liquid to provide a cavity at the lower end of the well.

U.S. Pat. No. 3,402,967 (Edmunds et al.) discloses a device that is similar in operation to the Dahms et al patents.

U.S. Pat. No. 3,547,191 (Malott) discloses an apparatus that is lowered into a well for the discharge of high pressure liquid through nozzle means 26,27. The discharge from the nozzle means passes through previously formed openings 35 in the casing.

U.S. Pat. No. 3,318,395 (Messmer) discloses a tool including a body of solid rocket propellant fuel 34 which is lowered to a desired position in a well. The rocket fuel is ignited and the exhaust discharges outwardly through nozzle means 36 to cut through the casing and the cement surrounding the casing. The discharge from the rocket includes abrasive particles which aid in the cutting operation and also serve to cut a notch in the surrounding formation to fracture same and hopefully improve production. However, as the discharge from the rocket, or any other fixedly positioned jet means, erodes the formation, the standoff distance between the nozzle and the formation increases and the effectiveness of the apparatus is greatly reduced.

U.S. Pat. No. 4,050,529 (Tagirov et al.) discloses a tool which is lowered down a well casing and includes nozzle means through which high pressure abrasive containing water is pumped to cut through both the casing and the surrounding formation. The use of abrasive materials, if not properly cleaned out, can pollute the well forever in that it creates monumental wear problems in valves, pumps and the like subsequently used with the well. Moreover, the abrasive is absorbed in the surrounding formation and also blocks the pores of the formation.

U.S. Pat. No. 4,346,761 (Skinner et al.) discloses a system including nozzles 20 mounted for vertical up and down movement in the casing to cut slots through the casing. The nozzle means does not protrude beyond the casing. However, the high pressure jet discharged from the nozzle would apparently effect some cutting of the surrounding strata.

Other patents disclosing high pressure nozzles for cutting well casing include U.S. Pat. No. 3,130,786 (Brown et al.); U.S. Pat. No. 3,145,776 (Pitman) and U.S. Pat. No. 4,134,453 (Love et al.). U.S. Reissue Pat. Re. No. 29,021 (Archibald) discloses an underground mining system employing a radial jet which remains in the well before for cutting the surrounding formation. U.S. Pat. No. 4,317,492 (Summers) discloses a high pressure water jet-type well system usable in mining and drilling operations in which a nozzle providing a jet is moved out the bottom of the well and is then moved radially. U.S. Pat. No. 3,873,156 (Jacoby) also discloses a jet-type mining device movable out the lower end of a well for forming a cavity in a salt well. U.S. Pat. No. 4,365,676 (Boyadjieff) discloses a mechanical drilling apparatus movable radially from a well for effecting a lateral bore hole. A number of additional U.S. patents for cutting the strata adjacent or at the bottom of a well are known in the art with these patents including U.S. Pat. Nos. 2,018,285; 2,258,001; 2,271,005; 2,345,816; 2,457,277; 2,707,616; 2,758,653; 2,796,129 and 2,838,117.

None of the aforementioned prior art devices have achieved any substantial degree of success due to a variety of shortcomings. For example, those devices which simply project a high pressure jet from a nozzle positioned solely inside the casing cannot cut outwardly from the casing a sufficient distance to be truly effective. Moreover, the direction and extent of the cut provided by such devices is subject to a number of variable parameters including the nature of the surrounding formation and it is therefore difficult to achieve a predictable result.

One problem with all high pressure-type jet devices operating through the wall of the well casing is that an aperture must be cut in the casing and the surrounding cement as a prerequisite to cutting through the surrounding formation. In some of the prior known devices the aperture can be cut with the nozzle jet itself whereas other devices require the use of separate mechanical cutting means. Those devices using nozzle jets for cutting the casing suffer from a very serious drawback in that the cutting liquid frequently includes abrasive particles which may remain in the casing and can subsequently adversely effect valves or other components such as pumps or the like into which some of the abrasive components are eventually indicated.

The use of separate mechanical cutting devices suffers from the shortcoming of requiring substantial additional expense both in terms of the cost of the extra equipment and the cost of time required in using same 30 for cutting the casing. This is true because such use will normally require lowering of the cutting device to the bottom of the well, cutting of the casing and subsequent removal of the cutting device and positioning of the jet means in the casing prior to usage of the nozzle jet-type cutter. The positioning and removal of tools from the well normally requires a time consuming and expensive pulling and replacement of the string.

A common shortcoming of all types of penetrators prior to the invention of U.S. Pat. No. 4,640,362 (Schellstede) was that they simply did not result in adequate penetration of the formation outwardly of the casing a sufficient distance to achieve improved production. Therefore, there had been a very substantial need for apparatus capable of effectively penetrating the earth formation surrounding a well casing for a distance outwardly beyond the casing outside the contamination zone surrounding the casing. A particular problem was the inability of many devices prior to Schellstede to maintain a proper standoff distance from a cutting jet providing means.

The invention of the aforementioned Schellstede patent represented a very significant advance in the penetration art in that it permitted penetration of the earth formation well beyond the contamination zones surrounding the casing as to provide a very superior performance compared to the prior known devices. Additionally, it permitted an initial jetting of cement away from the casing prior to outward movement of the jet providing semirigid, extendable, conduit and nozzle extension device. Moreover, the Schellstede device had other advantageous features flowing from its unique design. However, the device of the Schellstede patent is somewhat complicated in requiring hydraulic circuitry which includes two nitrogen accumulators, rotor actuators and valve sets and tubing flow lines all of which are mounted in a ten foot long housing. Additionally, operation of the Schellstede device requires that pressurized working fluid be provided to the apparatus at four different pressures each at different times during each cycle of operation. The overall length of the complete apparatus is consequently substantial and the use of flexible flow lines creates a substantial potential for leakage in view of the high pressure required during usage of the apparatus.

Prior U.S. Pat. No. 4,790,384 represented an improvement over the device of the aforementioned U.S. Pat. No. 4,640,362 in that it used only a single accumulator and was less complicated and more trouble free. However, the use of the single accumulator in the control head caused the apparatus to be somewhat time consuming to calibrate and use for some applications. Also, the device of the '362 patent required the expensive boring of lengthy bores through solid steel as part of the construction of the control portion of the apparatus.

The device of U.S. Pat. No. 4,928,757 a comprises an improvement over the device of the '384 patent and the control means used in the '757 patent is for the most part used in the present application. However, a shortcoming of the device of the '757 patent is the fact that high levels of pressure in the casing can cause the control valve to shift and result in an unintended extension of the punch; one aspect of the present invention corrects this shortcoming.

It is consequently the primary object of the present invention to provide a new and improved apparatus for penetrating earth formations around a well casing.

Another object of the invention is the provision of an improved method of gravel packing a well.

Yet another object of the present invention is the provision of a new and improved earth cutting nozzle and method for providing a bulbous shaped earth cavity.

SUMMARY OF THE INVENTION

The preferred embodiment for practice of the invention comprises an elongated generally cylindrical housing capable of being lowered down a well casing and having a control means including a coil compression spring means for positioning a movable control valve spool in a first position of operation so as to provide a smaller, cheaper and more reliable control assembly for controlling the remaining operative downhole components of the preferred embodiment. The remaining operative components include cam drive cylinder means for driving an improved design wedging cam to extend a radially movable punch outwardly through the casing of a well. The control means is essentially the same as that disclosed in U.S Pat. No. 4,928,757 with the exception of the fact that the means for causing the movement of an extendable semi-rigid, extendable conduit and nozzle extension device or "lance" which has a nozzle at its outer end movable outwardly through the punch is not employed in the preferred embodiment of the present invention since the "lance" is not used in the preferred embodiment. However, the means for causing movement of the "lance" of said patent is employed in another aspect of the present invention.

The control valve spool is provided in a cylindrical housing for axial reciprocation between first and second positions and is normally urged to a first position by the coil compression spring in which it directs working fluid at a relatively low pressure to a punch cam drive cylinder to position the cam so that the cam and the punch are in a retracted position.

While means for providing the control functions are taught in U.S. Pat. Nos. 4,790,384 and 4,640,362, the present invention employs different, smaller, and less bulky control means for effecting these functions. After the tool is lowered down the casing to a desired position, but prior to beginning a penetration operation, the movable valve spool member is in its first or "retract" position as a consequence of working fluid being supplied at a pressure that is less than a critical pressure. A penetration operation is initiated by increasing the pressure of the working fluid to a value exceeding the critical pressure. The working fluid is then at a sufficiently high pressure to overcome the force exerted by the coil compression spring on the movable valve spool so that the movable valve spool is moved by the pressure of the working fluid to a second or "extend" position. The shifting movement of the movable valve spool to its second position results in the sending of working fluid to the punch drive cam cylinder so that the cylinder is actuated to extend the nozzle punch outwardly to punch or cut a hole in the casing. The shifting movement of the valve spool to its second position also results in the simultaneous supplying of working fluid to the nozzle punch to create a high pressure jet exiting in an axial direction forwardly of the nozzle punch. The work fluid flows from the control valve to the punch through a metal tube which is in a bowed compressed condition when the nozzle punch is in its retracted position but which straightens out somewhat as the punch moves to its extended position. The working fluid jet initially impinges on the interior of the casing in the area of the casing being punched by the nozzle punch to create a small additional force on the casing area to slightly speed up the failure of the casing area engaged by the nozzle punch and to permit the working fluid to immediately flow outwardly into the formation as soon as a crack develops in the casing area contacted by the nozzle punch. Consequently, the cement and earth formation is eroded away behind the casing area so as to permit an easy deflection outwardly of side tabs of the casing resultant from the nozzle punch movement.

After the opening in the casing is completed, the nozzle in the nozzle punch continues discharging a high pressure liquid jet into the formation to provide an opening extending outwardly beyond the casing so as to provide a bulbous shaped cavity which is larger on its outer end than its inner end adjacent the casing. When the bulbous shaped cavity is completed, the pressure in the tubing string is reduced to its lower level so that the piston spool assembly shifts back to its first position to cause the punch cam cylinder to return to its initial position so that the punch is retracted back into the housing of the apparatus. The entire apparatus is then removed from the well and when the system is being used for a gravel packing operation, a conventional gravel placement tool is lowered down the well and positioned adjacent the perforation where it is activated to fill the bulbous cavity with a gravel slurry which hardens to form a unitary porous mass after a given time interval. The bulbous shape of the cavity and the matching shape of the unitary gravel mass are such that the mass cannot move into the casing. The nozzle-punch arrangement can also be used for a multitude of operations other than gravel packing operations; for example, it can be used for quickly making a large number of holes in a pipe or casing, cutting general purpose openings in heavy wall pipe or thick cement, for solution mining of various minerals, for providing large reliable holes for fracture treatments and to provide entry holes for selective cement squeezing operations.

A second embodiment of the invention employs a device of the type shown in prior U.S. Pat. No. 4,928,757 in which a "lance" in the form of a high pressure hose having a unique nozzle on its outer end is extended out into the formation to form a cavity; however, the new and unique side-porting nozzle provided on the outer end of the lance for practice of the invention provides improved results. The new and unique side-porting nozzle is operated at a first pressure during extension of the lance into the formation with a forwardly facing nozzle operating to cut away the formation in essentially the same way as shown in the '757 patent; however, when the lance reaches the outer extent of its movement, the pressure in the lance is increased to a level exceeding the critical nozzle pressure which results in a shifting of a means in the nozzle housing causing a portion of the liquid in the nozzle to be directed outwardly in a plurality of radial jets in a transverse direction relative to the axis of the nozzle body. The radial jets quickly act to enlarge the cavity to create a large cavity which bulges at its outer end buy has a relatively narrow thin portion of reduced diameter connecting the outer end to the large bulbous portion. One or more cavities of the aforementioned type can be formed; the apparatus is then removed and the cavity or cavities filled with a gravel slurry which hardens in due course in the manner previously described.

BRIEF DESCRIPTION OF THE DRAWINGS

FIG. 7A is an enlarged sectional view of the upper end of a control section of the apparatus taken along lines 7—7 of FIG. 1 illustrating the unactivated position of parts of the apparatus prior to initiation of the first step in the practice of the invention;

FIG. 7B is a sectional view of the control section taken along the same section as FIG. 7A and illustrating the portions of the control section below those of FIG. 7A with the parts in FIG. 7B being in the unactivated position as in FIG. 7A;

FIG. 18A' is a sectional view taken along lines 18A'—18A' of FIG. 18A;

FIG. 19A is a sectional view taken along the same section as FIG. 16 but illustrating the parts in an activated condition corresponding to FIGS. 8A, 8B, etc.;

FIG. 19B is a sectional view similar to that of FIG. 19A illustrating the portion of the equipment immediately below that of FIG. 19A with the parts being in an activated condition;

FIG. 40 is a bottom plan view of an alternative sub for connecting the valve means with the punch section;

FIG. 41 is a sectional view taken along lines 41—41 of FIG. 40;

FIG. 42 is a top plan view of the connector of FIG. 40;

FIG. 43 is a sectional view taken along lines 43—43 of FIG. 42;

FIG. 44 is a sectional view taken along lines 44—44 of FIG. 40;

DESCRIPTION OF THE PREFERRED EMBODIMENT

Figure 1:
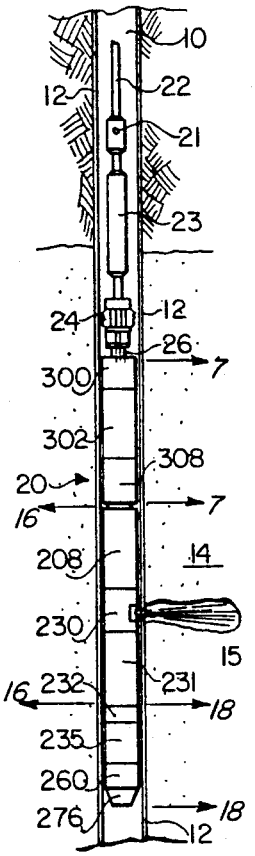
FIG. 1 is a front elevation view illustrating a gas or oil well in vertical section and showing the manner of employment of the inventive apparatus and method.

The apparatus for practice of the subject invention is illustrated in FIG. 1 in a well 10 having a casing 12 extending through a strata 14 in which it is desired to initiate or increase production. The equipment illustrated in FIG. 1 operates to effect penetration through the casing 12 and any surrounding cement blanket (if present) into the strata 14 of the surrounding formation to provide one or more bulbous shaped cavities 15 into which gravel packing can be subsequently injected.

More specifically, the equipment comprises an elongated downhole apparatus 20 suspended from the surface by a pipe string 22 comprising a plurality of conventional tubular pipe sections with the lowermost pipe section being connected to a circulating valve 21, a filter 23 and a stabilizer/anchor 24 of conventional construction which includes selectively operable means which is outwardly expandable for engagement with the inner wall of the casing 12 so as to anchor the stabilizer/anchor in fixed position with respect to the casing. The upper end of the elongated apparatus 20 is supported from stabilizer/anchor 24 by a threaded short tubing connection section 26.

The upper above-ground end of the string 22 is connected as shown in FIG. 1 of the U.S. Pat. No. 4,640,362 to a swivel supported by conventional means of a workover rig or the like and is connected by low pressure hose means and high pressure hose means to sources of pressurized work fluid which is usually water. The hose members extend from a vehicle which has a console control panel which provides control for a motor driving conventional high pressure and low pressure pump means and control valves connected to the hose members. The pumps receive work fluid from a suction line extending from a conventional two-state element filter assembly which receives the unfiltered working fluid from a tank truck and filters out all particles greater than 20 microns in size. However, even finer filters can be used. The high pressure pump is an acid service trimmed five piston positive displacement pump which provides a low frequency pulsating output, the frequency of which can be adjusted. Pumps with a different number of cylinders could also be employed.

The elongated downhole apparatus 20 is formed of a plurality of connected tubular housing members in which various functions and equipment are provided. The function providing housing sections from top to bottom as illustrated in FIG. 1 include a control section and a punch/nozzle section as will be discussed.

The control section is best illustrated in FIGS. 7A, 7B, 8A, 8B, 9A and 9B and is concentric with respect to a vertical axis A extending along its length. The upper end of the control section is defined by a threaded sub 300 threaded on the lower end of the short tube threaded connection section 26 of the invention disclosed in Schellstede et al. U.S. Pat. No. 4,790,384 with the interior of sub 300 constituting a work fluid input means. Sub 300 supports a threaded cylindrical housing 302 threaded on the lower end of sub 300 by means of upper internal threads 304 of housing 302 (FIG. 7A). Lower internal threads 306 of housing 302 are threadably connected to the upper end of a valve housing cylinder 308 as shown adjacent the lower end of FIG. 7A.

A cylindrical bore 310 (FIG. 7A) in the threaded cylindrical housing 302 is positioned between the upper and lower internal threads 304 and 306 and defines a spring chamber in which a heavy duty coil compression spring 312 is positioned. The upper end of coil compression spring 312 engages the lowermost one of a pair of brass washers 314 which are axially positioned over a threaded connector 316 having an uppermost axial bore 318 at its upper end communicating at its lower end with the upper end of a reduced diameter axial bore 320 of slightly less diameter. Axial bore 320 in turn communicates at its lower end with a larger diameter bore 330 having internal threads 332 into which the upper end of a movable valve spool member 334 having an axial valve bore 335 is threadably received.

Figure 8A:
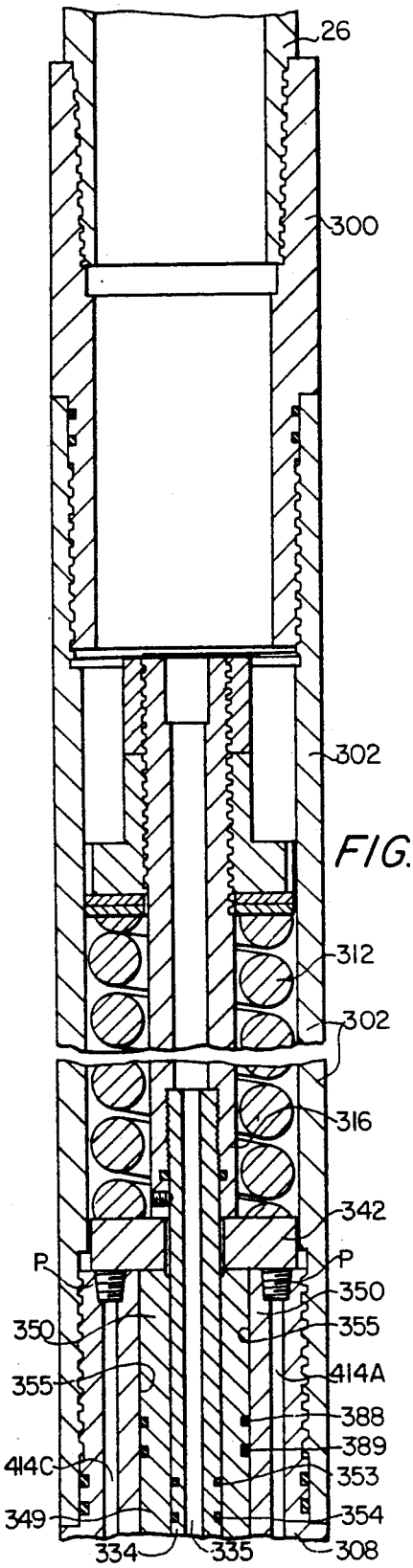
FIGS. 8A and 8B are sectional views corresponding to FIGS. 7A and 7B, but which illustrate the parts in their activated position.
Figure 8B:
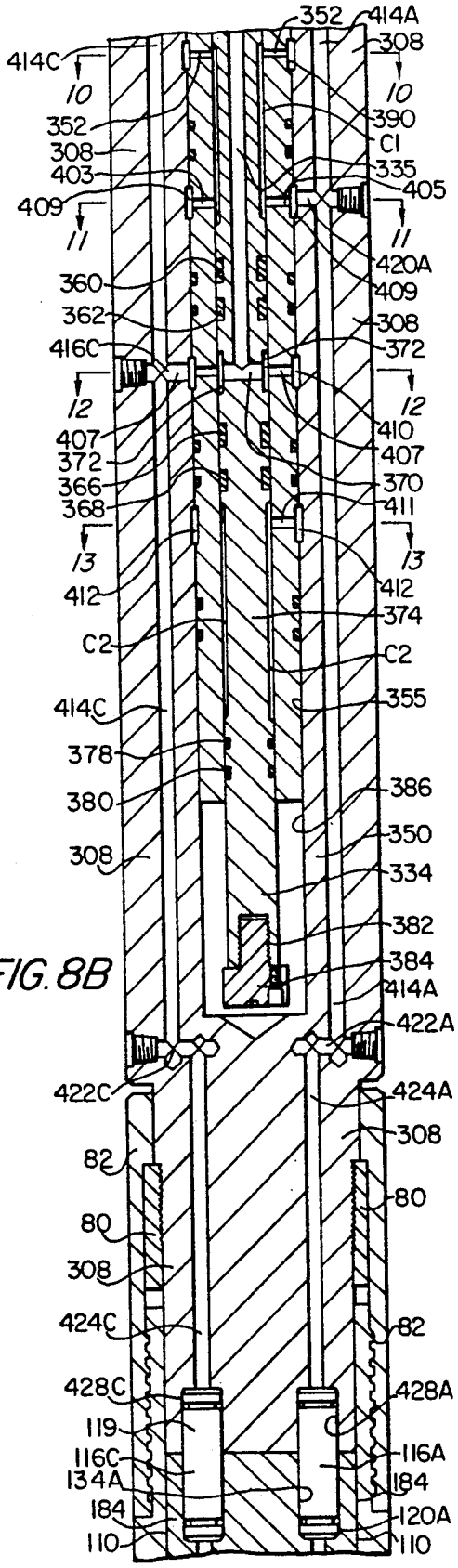
Figure 9A:
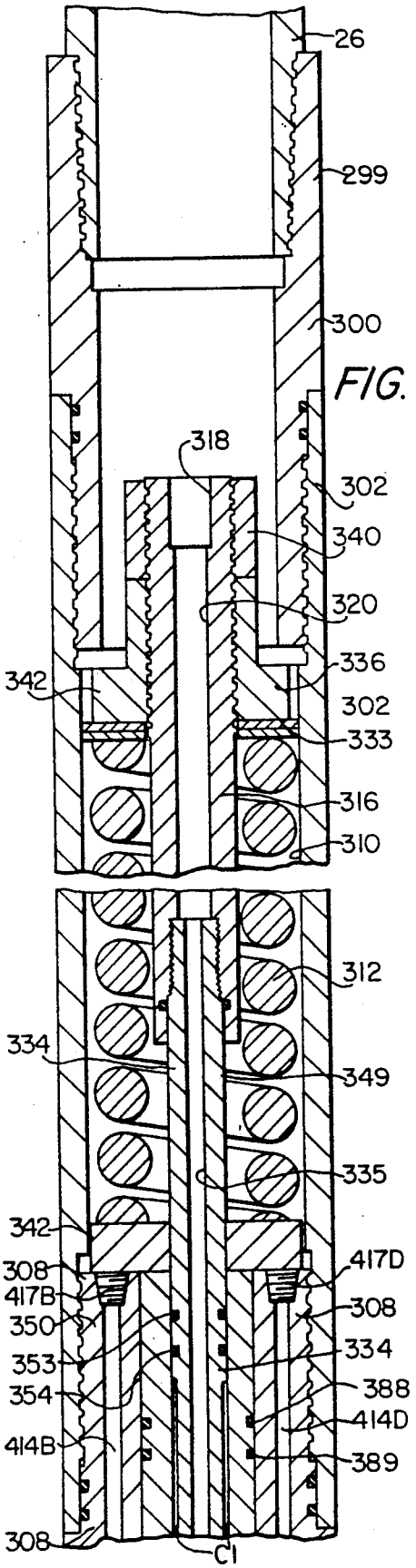
FIG. 9A is a sectional view taken along lines 9A—9A of FIG. 7A.
Figure 9B:
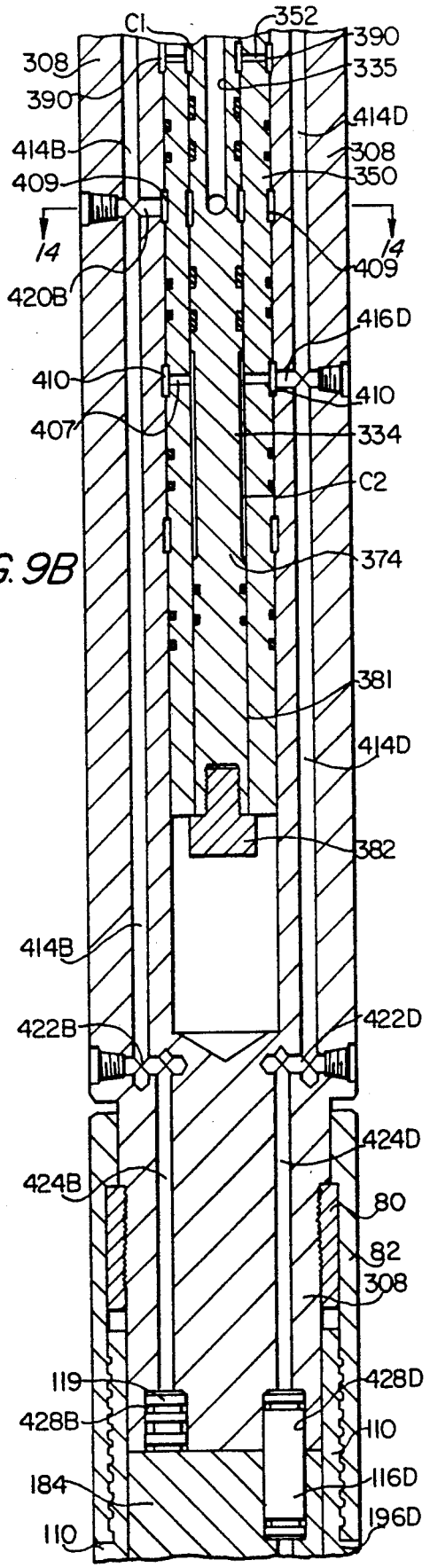
FIG. 9B is a sectional view taken along lines 9B—9B of FIG. 7B.

The uppermost one of the brass washers 314 engages the lower radial end surface 333 of a loading nut 336 which is threaded on external threads 338 on the upper end of threaded connector 316; adjustment of loading nut 336 varies the amount of compression of spring 312 and likewise varies the amount of upward force exerted by spring 312 on movable valve spool member 334 so as to vary the critical pressure in the interior of sub 300 required to overcome the force of spring 312 to shift the valve spool member 334 from its FIG. 7A, 7B position to its FIG. 8A, 8B position to initiate a casing penetration operation. A lock nut 340 is threaded on the external threads 338 for holding the loading nut 336 in its adjusted position.

The lower end of coil compression spring 312 engage a stop ring 342 which is urged downwardly against the upper end of the valve housing cylinder 308 by spring 312. It should be observed that there is a clearance space between the outer surface of movable valve spool member 334 and a cylindrical bore 344 provided in fixed stop ring 342. It should also be noted that the stop ring 342 is fixed to the upper end of valve housing cylinder 308 by bolt means or other conventional means (not shown).

The movable valve spool member 334 is mounted for axial movement in an axial bore 348 of a valve body sleeve 350 mounted coaxially in an axial bore 355 of the valve housing cylinder 308. Movable valve spool member 334 includes an upper larger diameter spool portion 351 in which circular seal means 353 and 354 are mounted for contact with axial bore 348 of valve body sleeve 350 as shown in FIG. 7A. An upper reduced diameter spool portion 356 is provided immediately below larger diameter spool portion 351 which in conjunction with bore 348 in valve body sleeve 350 defines a first or upper movable cylindrical shaped chamber C1. Circular seal means 360, 362 engaging axial bore 348 (FIG. 8B) are provided in circular grooves in an upper portion of a central larger diameter spool portion 364 of movable valve member 334 immediately below upper reduced diameter spool portion 356. Thus, movable upper chamber C1 is sealed at its upper end by seals 353, 354 and at its lower end by seals 360, 362.

Additionally, the lower end of the central larger diameter spool portion 364 is provided with circular seal means 366, 368. It should also be noted that a transverse bore 370 extends diametrically through the axis of movable valve member 334 and spool bore 335 at a location between seal means 362 and 366 a shown in FIGS. 7B and 8B. Seal means 360, 362, 366 and 368 are formed of polyetheretherketone (PEEK) and all of the other seals are rubber O-rings.

Figure 12:
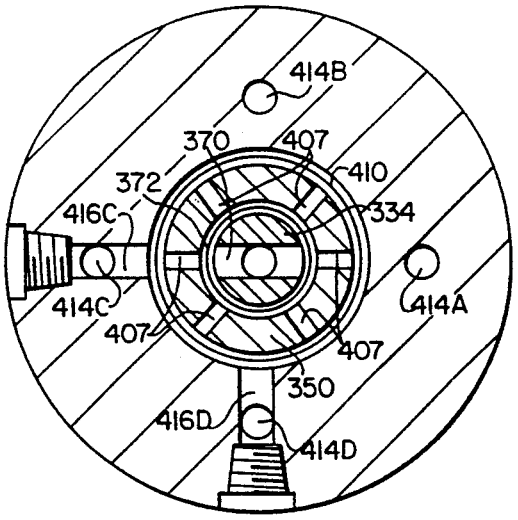
FIG. 12 is a sectional view taken along lines 12—12 of FIG. 8B.

The outer ends of transverse bore 370 communicate with an annular chamber groove 372 which is formed in and encircles the outer periphery of valve spool member 334 as best shown in FIGS. 8B and 12. A lower reduced diameter spool portion 374 is provided in the outer surface of movable valve spool member 334 below seal means 368 and cooperates with bore 348 to define a second or lower movable chamber C2 (FIG. 7B). Seal means 378, 380 are provided in a lower large diameter spool portion 381 of valve spool member 334 below the lower reduced diameter portion 374.

A stop member 382 (FIG. 79) is threaded in the lower end of movable valve spool member 334 and has a head portion 384 of greater diameter than the outer diameter of the lower large diameter portion 38 of valve spool member 334. Head portion 384 is positioned in an internal lower end chamber defined by bore 386 in valve body sleeve 350. A radial shoulder 387 joining bores 348 and 386 defines a stop which engages the upper surface of head portion 384 to limit upward movement of movable valve spool member 334.

Figure 10:
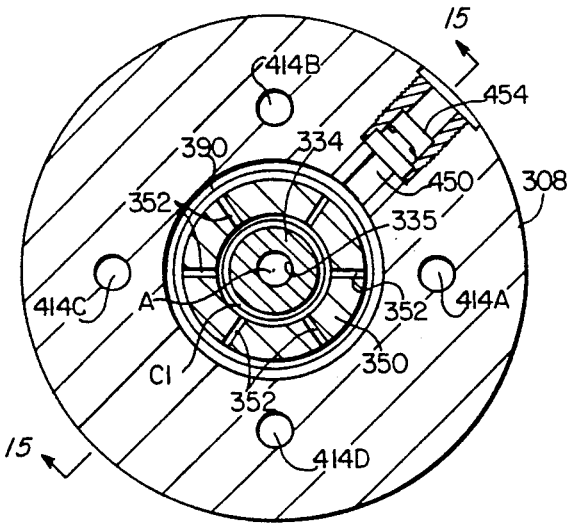
FIG. 10 is a sectional view taken along lines 10—10 of FIG. 8B.
Figure 11:
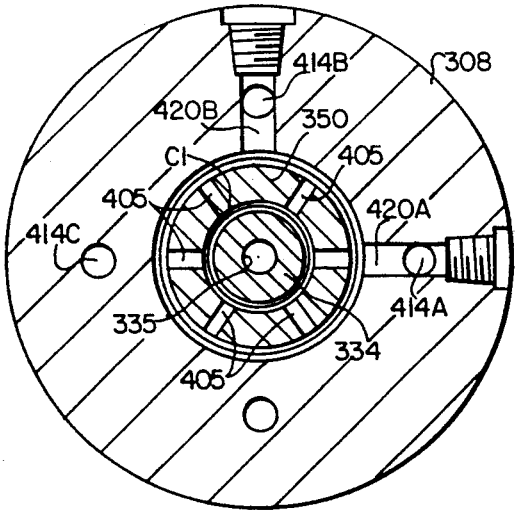
FIG. 11 is a sectional view taken along lines 11—11 of FIG. 8B.
Figure 13:
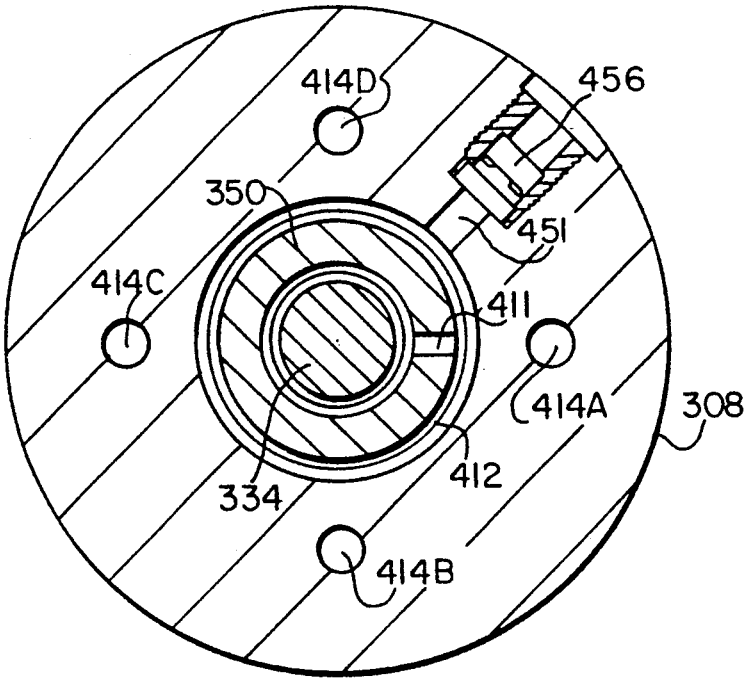
FIG. 13 is a sectional view taken along lines 13—13 of FIG. 8B.
Figure 15:
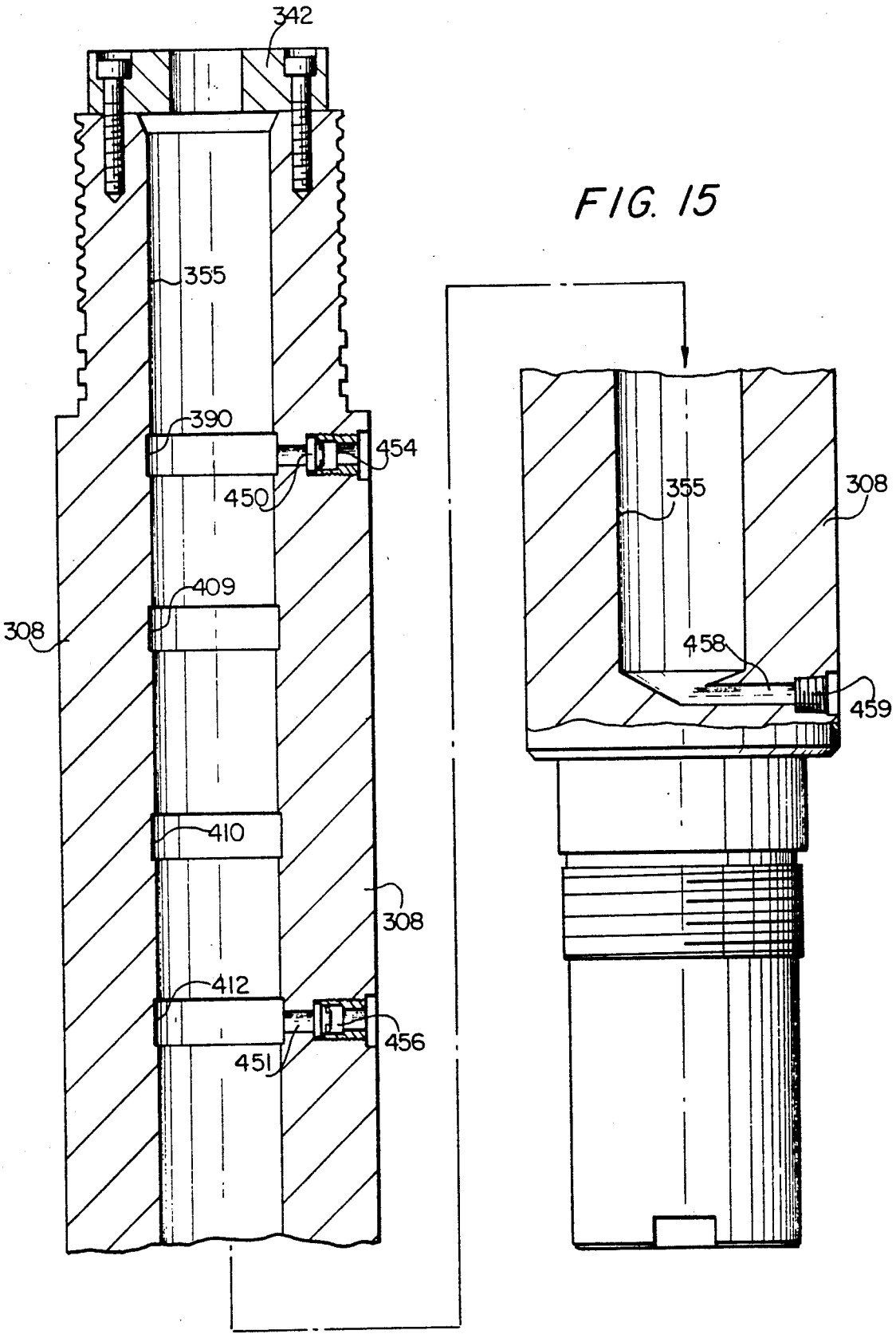
FIG. 15 is a sectional view taken along lines 15—15 of FIG. 10.

Valve body sleeve 350 is provided with a plurality of upper radial bores 352 as shown in FIG. 10 which are horizontally positioned in a common plane perpendicular to the axis A of valve body sleeve 350 and movable valve spool member 334; the outer ends of bores 352 communicate with an annular chamber 390 (FIG. 15) formed of facing grooves in valve body sleeve 350 and valve housing cylinder 308. Similarly, a plurality of upper central horizontal bores 405 (FIGS. 8B and 11) are provided at a location immediately below the upper radial bores 352 and communicate on their outer ends with an annular chamber 409 formed of facing grooves in sleeve 350 and housing 308. Lower central bores 407 (FIGS. 8B and 12) similarly extend through valve body sleeve 350 and have outer ends communicating with an annular chamber 410 formed of facing annular grooves in valve housing cylinder 308 and valve body sleeve 350. In like manner, a lowermost radial bore 411 extends transversely through the valve body sleeve 350 as best shown in FIGS. 8B and 13; the outer end of bore 411 communicates with an annular chamber 412 (FIGS. 8B and 15) formed in valve housing cylinder 308 and valve body sleeve 350 and the inner end communicates with the movable chamber C2 as shown in FIG. 8B.

Valve body sleeve 350 also includes upper seals 388 389 (FIGS. 8A and 9A) provided in its outer surface and engaging the axial bore 355 of valve housing cylinder 308. Additional seal means 392, 394, 396, 398, 399, 400, 402 and 404 are also provided in the outer surface of valve body sleeve 350 for sealing contact with the inner bore 355 of valve housing cylinder 308 as shown in FIG. 8*b*.

Figure 14:
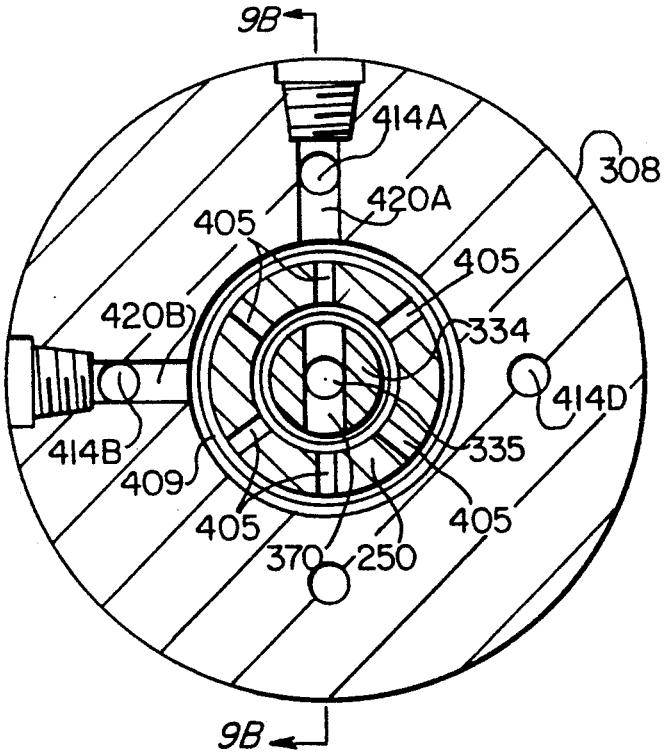
FIG. 14 is a sectional view taken along lines 14—14 of FIG. 9B.

Axially parallel bores 414A (FIG. 8A), 4148 (FIG. 9A), 414C (FIG. 7A) and 414D (FIG. 9A) extend downwardly from the upper end of valve housing cylinder 308 and are all shown in FIGS. 10 and 14. Bores 414A, 4148, 414C and 4140 are each respectively provided with plug means 417A, 417B, 417C and 417D at their upper ends for sealingly closing their upper ends. Bore 414A communicates with an upper radial bore 420A having an inner end communicating with annular chamber 409 and has its lower end terminating at a lower radial bore 422A (FIG. 8B). A lower axially parallel bore 424A has its upper end connected to the inner end of radial bore 422A and terminates at its lower end in a female coupling/seal bore 428A. Similarly, axially parallel bore 414B communicates with an upper radial bore 420B (FIG. 9B) and a lower radial bore 4228 having an inner end in communication with the upper end of a lower axially parallel bore 424B which terminates at its lower end at a larger female plug/seal bore 428B which is dimensioned to receive a seal/plug 119 which includes rubber or the like ring seals 121 engaged with the surface of bore 428B so as to sealingly close the lower end of bore 424B. The lower end of seal/plug 119 engages the upper surface of a bottom dowel sub 184 which is connected to valve housing cylinder 308 by a coupling sleeve 82, a back-up ring 80 and a heavy connector sleeve 110.

The axially parallel bore 414C is connected to an upper radial bore 416C and terminates at its lower end in a lower radial bore 422C which is connected to the upper end of a lower axially parallel bore 424C which terminates at its lower end in a female coupling seal bore 428C. Axially parallel bore 414D similarly communicates within an upper radial bore 416D and terminates at its lower end in a lower radial bore 422D which is connected to the upper end of a lower axially parallel bore 424D which has a lower end communicating with a female coupling/seal bore 428D.

Figure 45:
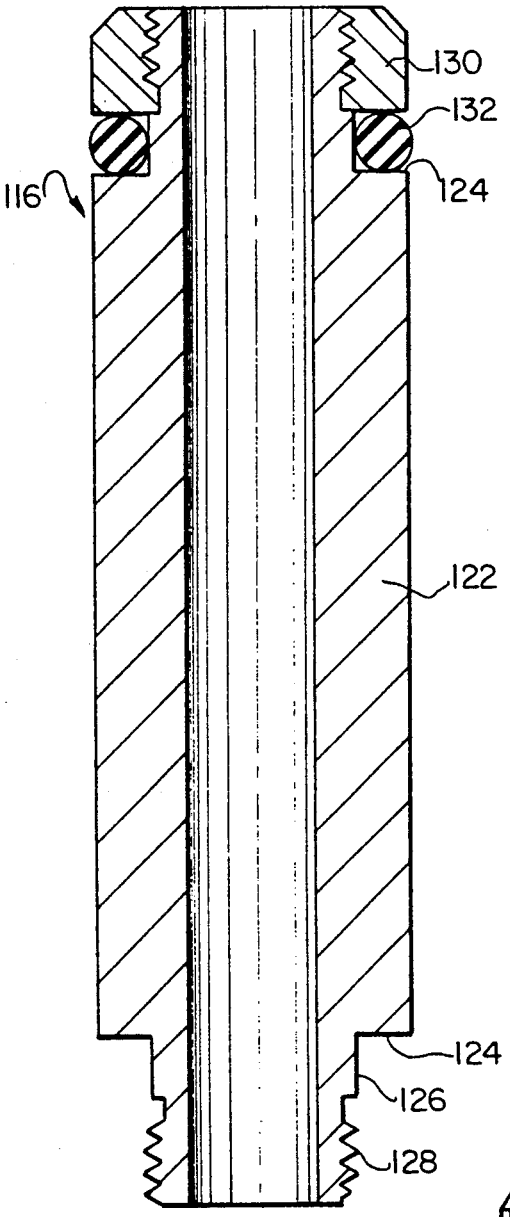
FIG. 45 is a bisecting vertical section of a floating dowel employed in the preferred embodiment of the invention.
Figure 46:
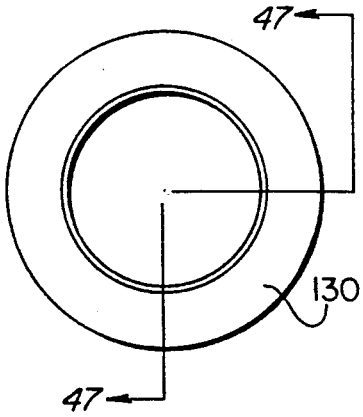
FIG. 46 is a top plan view of an end nut employed in the preferred embodiment.
Figure 47:
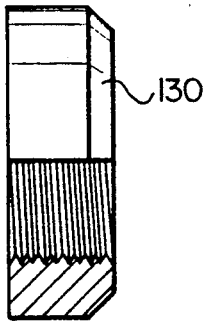
FIG. 47 is a sectional view taken along lines 47—47 of FIG. 46.
Figure 48:
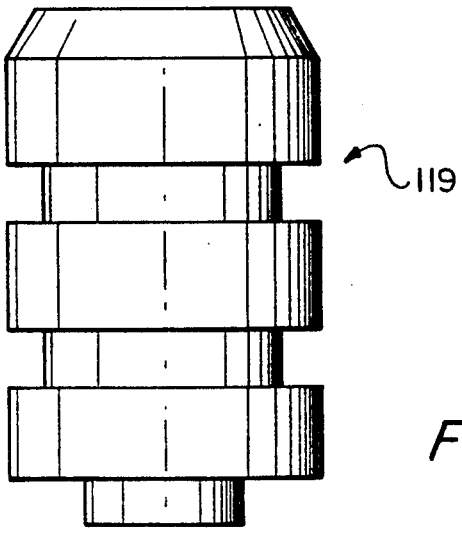
FIG. 48 is a side elevation view of a plug employed in the nozzle-punch assembly.

Identical male flow connector members comprising floating dowel members 116A, 116C and 116D have their upper ends respectively received in the coupling-/seal bores 428A, 428C and 428D. The construction of the floating dowel members is illustrated in detail by that of floating dowel 116 in FIG. 45. More specifically, each floating dowel includes a cylindrical body portion 122 and a ring seal seat comprising radial surfaces 124 and cylindrical surfaces 126 provided at each end inwardly of threaded surfaces 128. A seal retaining end nut 130 is threaded on each threaded surface 128 so as to hold a cylindrical seal 132 formed of rubber or other suitable material in position on surfaces 124 and 126 in the manner shown on one end of member 116 in FIG.

45. It should be understood that in use such seal means are provided on both ends of the floating dowels.

Figure 16:
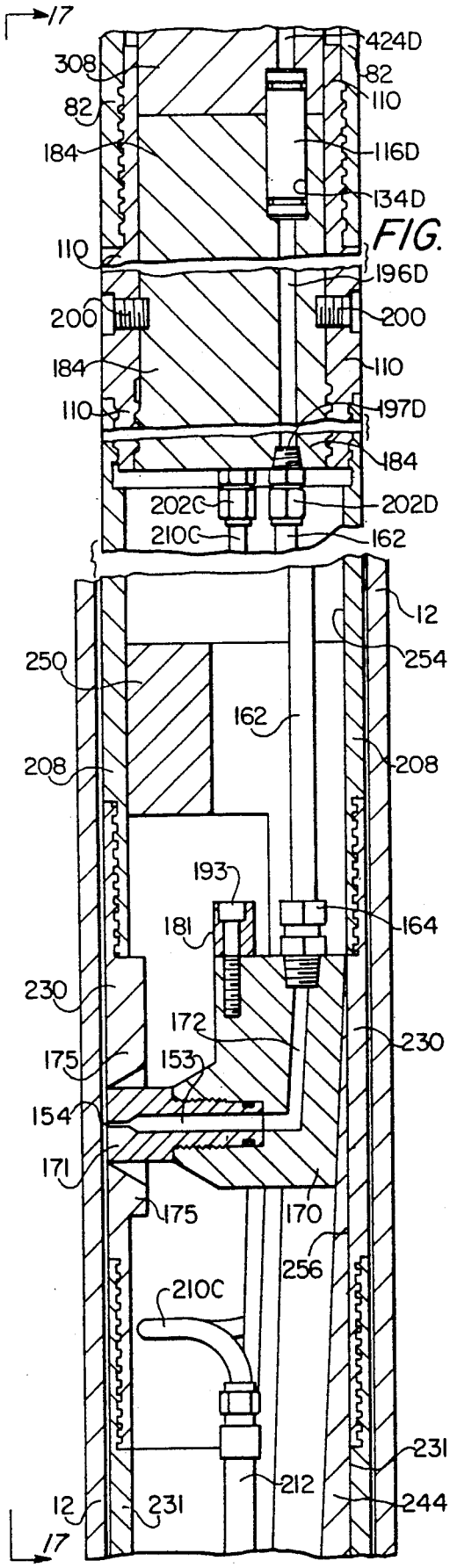
FIG. 16 is a sectional view taken along the same section as FIG. 9B illustrating the punch/nozzle cam drive housing means positioned below the control means of FIG. 9B with the parts being in deactivated condition corresponding to FIGS. 7A, 7B, etc.
Figure 17:
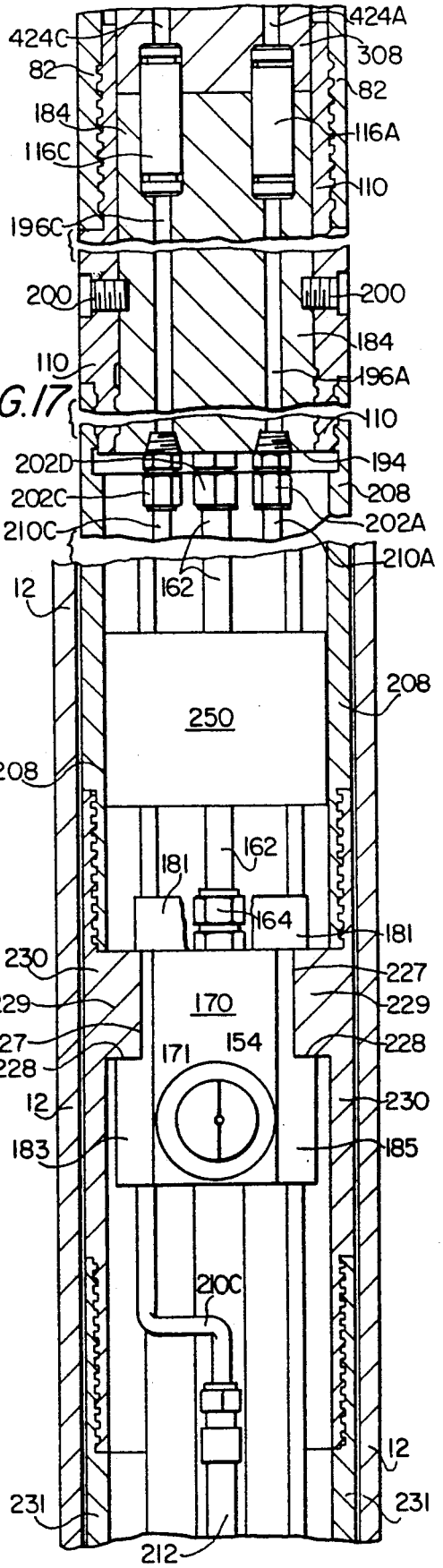
FIG. 17 is a sectional view taken along lines 17—17 of FIG. 16.

The lower ends of the floating dowel members 116A, 116C and 116D are respectively received in female coupling/seal bores 134A, 134C and 134D extending downwardly from the upper end surface 192 of a bottom dowel sub 184. Bottom dowel sub 184 is formed of a solid steel cylinder having upper end 192, lower end 194 and cylindrical outer surface 195. A positioning key 199 extends upwardly from upper end surface 192 and is matingly received in a female opening in the lower end of valve housing cylinder 308 to insure accurate rotational alignment of members 184 and 308. Axially parallel bores 196A, 196C and 196D extend downwardly from coupling/seal bores 134A, 134C and 134D respectively and terminate in threaded openings 197A, 197C and 197D extending upwardly from the lower end surface 194 of bottom dowel sub 184. Tube fittings 202A, 202C and 202D are respectively mounted in threaded openings 197A, 197C and 197D. The upper ends of conduits 210C, 162 and 210A are respectively connected to tube fittings 202C, 202D and 202A as shown in FIG. 17. Diametrically opposed oval recesses 198 are provided in surface 195 to receive the inner ends of locking lugs 200 which are threadably mounted in heavy connector sleeve 110 as shown in FIG. 16.

Valve housing cylinder 308 also includes exhaust bores 450 and 451 (FIG. 15) which respectively communicate on their inner ends with annular chambers 390 and 412. The outer ends of exhaust bores 450, 451 respectively communicate with check valves 454, 456 through which fluid can flow outwardly for discharge from housing 308 but which prevent the flow of liquid from outside the housing into bores 450 and 451. A pressure compensating bore 458 at the lower end of axial bore 355 is normally plugged by plug means at 459, however, the plug is removed for certain operations as discussed in the following paragraph.

More specifically, if plug 459 is positioned in pressure compensating bore 458, the hydrostatic pressure in the string only acts on the upper end of the valve spool 334 to provide a force downwardly on the valve spool in a direction against the force of spring 312 so as to tend to overcome the spring and move the valve spool to its FIG. 8A position. Thus, a heavier spring might be required for deep wells in order to prevent the string hydrostatic pressure inside sub 300 from moving the valve spool 334 to its FIG. 8A position. However, by removing plug 459 from bore 458, this problem can be avoided in wells having fluid in the casing since such removal causes the hydrostatic pressure of fluid in the casing exterior of the housing to push upwardly on the lower end of the valve spool to at least partially counteract the downward force on the upper end of the valve spool 334 caused by the hydrostatic pressure in the interior of sub 300. If the casing is full of fluid, the hydrostatic pressure in sub 300 will be counteracted. It is consequently frequently possible to avoid the need for replacing the coil spring for a particular job by simply removing plug 456; a further advantage is that it is possible to calibrate the valve at the surface prior to lowering the tool down a well without there being any need to consider the effects of hydrostatic pressure.

A substantial advantage arises from the fact that one section of the tool can be easily replaced in the field without a complete disassembly of the tool being necessary. Stated differently, the valve housing and cam housing sections are simply disconnected and the new section easily substituted and the apparatus sections reconnected in a quick and easy manner. Thus, a great advantage is enabled by the fact that during testing and operation of the device, if one section malfunctions, it can consequently be easily replaced with a minimum of difficulty.

The lower end of the valve housing cylinder 308 is connected to the upper end of the upper punch cam housing section 208 by a back-up ring 80 (FIG. 7B) threaded onto the outer surface of valve housing cylinder 308 and a coupling sleeve 82 threaded at its lower end onto a heavy threaded connector sleeve 110. Coupling sleeve 82 is fitted over the back-up ring 80 so that members 80 and 82 abut to preclude any additional downward movement of coupling sleeve 82. Bottom dowel sleeve 184 is held in position in sleeve 110 by plural threaded lugs 200 (FIG. 16) which extend into the oval recesses 198 of the dowel sleeve. The lower end of connector sleeve 110 has external threads on which the upper end of upper punch cam housing 208 is threadably connected. A punch housing 230 includes a thickened guide block wall portion 175 and is threaded at its upper end onto external threads provided on the lower end of the upper punch cam housing 208. A lower punch cam housing 231 is threaded at its upper end to the lower end of punch housing 230 and is threaded at its lower end to the upper end of rod guide head block 232. Rod guide head block 232 (FIG. 18A) is threaded on its lower end to the upper end of punch cam drive cylinder 235 to the lower end of which bull ring sub 260 is threaded. A cap head 276 is threaded on the lower end of bull ring sub 260 as shown in FIG. 19A.

A punch drive piston 236 which is formed of two main piston components 236A and 236B that are threaded together is mounted for reciprocation in bore 235' of punch cam drive cylinder 235 and includes an axial aperture through which a hollow rod 212 extends. It should be understood that piston 236 can reciprocate relative to rod 212 and that leakage from one side of the piston to the other side of the piston is precluded by virtue of rod seal means 239 engaging the outer surface of rod 212 as shown in FIG. 18B; also, brass bushing 214 mounted in the lower end of rod bore 240 of rod 238 and similar brass bushing 252 in the upper end of bore 240 engage rod 212. An annular face seal 234 formed of rubber or the like is mounted on the lower end of piston 236 and includes an annular groove 237 concentric to the axis of piston 236 which serves a purpose to be discussed.

The lower end of hollow rod 212 is held in a lower axial bore 257 and an upper reduced diameter bore 259 of bull plug sub 260 which is threadably mounted on the lower end of punch cam drive cylinder 235. More specifically, a threaded flowline connector bolt 261 is threaded into the lower end of hollow rod 212 and has an axial bore 265 extending its entire length to provide communication between bore space 266 in the lower end of bull plug 260 and flow passageway 214 extending the length of hollow rod 212. Bull plug 260 includes a main bore 269 concentric and axially aligned with bore 235' and an end wall surface 271 from which an upwardly extending cylindrical seal flange 274 extends in alignment with the annular seal groove 233 in seal 234. Additionally, a retainer 262 which includes four parallel bores 263 which communicate the space 266 below retainer 262 with bore 259 and the lower surface 253 of piston 236 as shown in FIG. 18B is held in position by the flowline connector bolt 261.

Figure 18A:
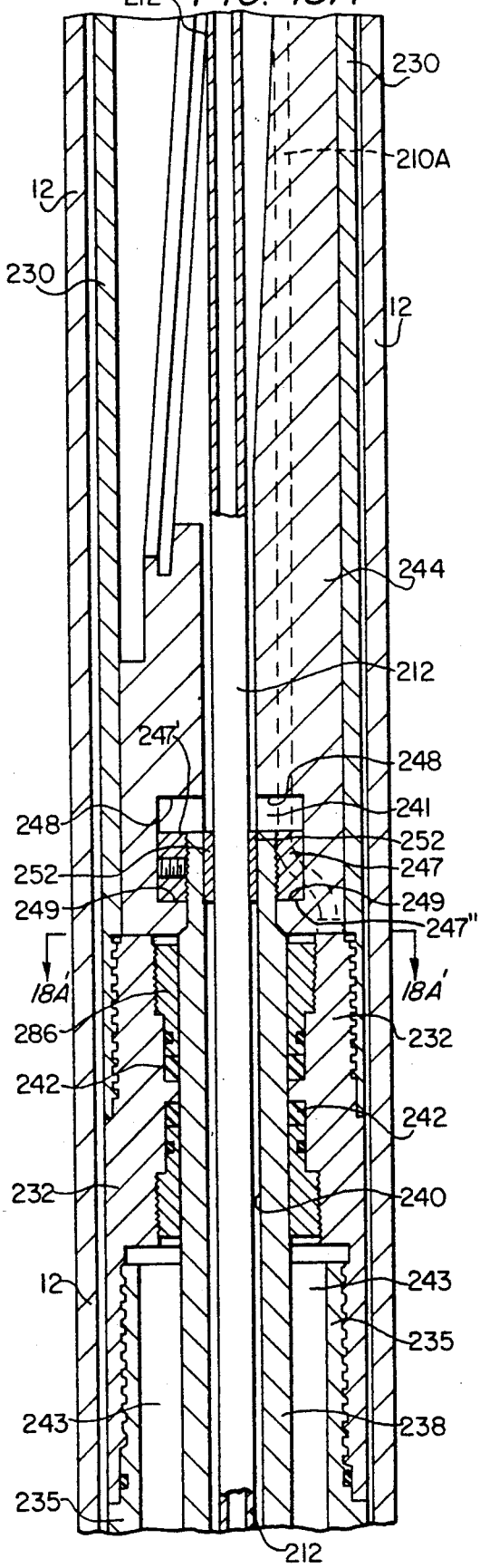
FIG. 18A is a sectional view taken along the same section as FIGS. 9A and 9B with the parts being in deactivated condition.
Figure 18B:
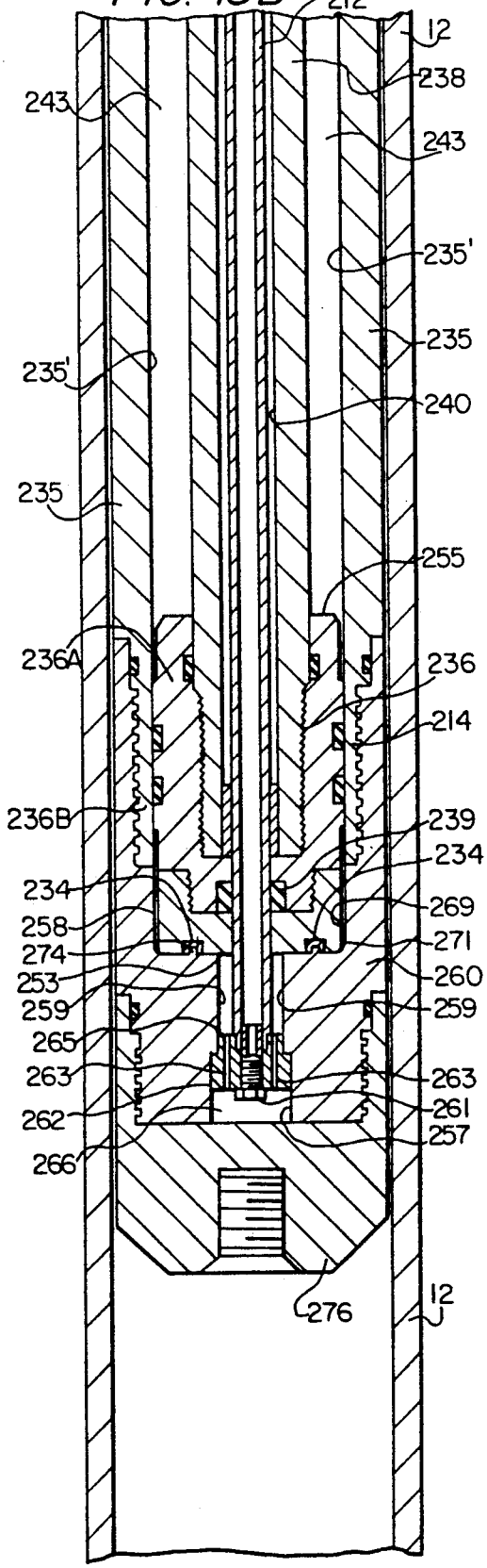
FIG. 18B is a sectional view taken along the same section as FIG. 18A and illustrating the portion of the apparatus immediately below that illustrated in FIG. 18A.
Figure 18A:
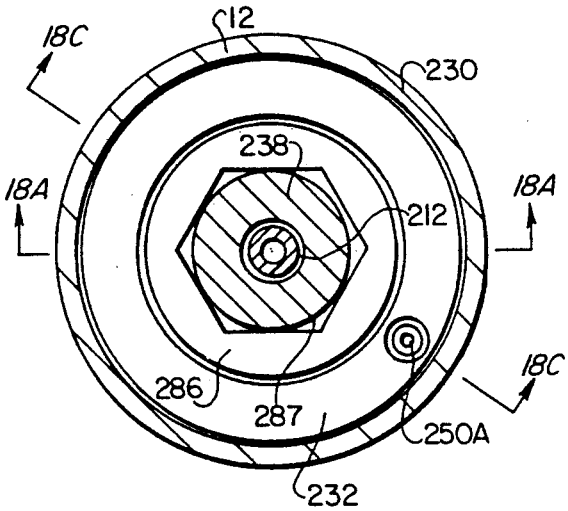
Figure 18C:
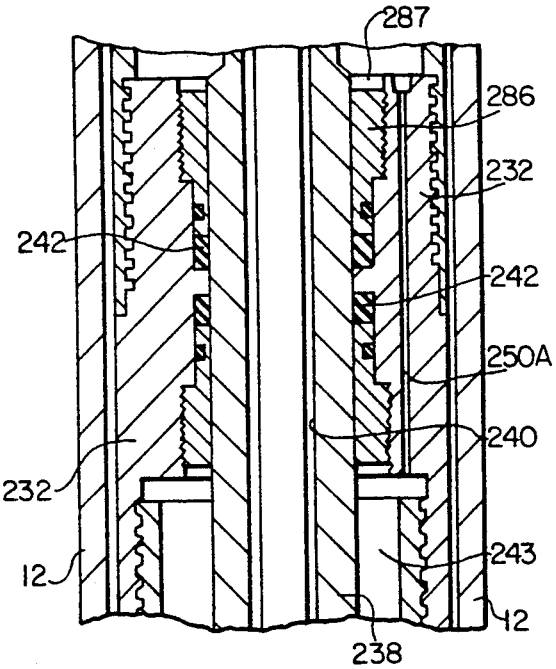
FIG. 18C is a sectional view taken along lines 18C—18C of FIG. 18A'.

It should also be observed that the hollow rod 212 is mounted axially in rod bore 240 (FIG. 18B) in a punch cam drive rod 238 threaded at its upper end to a lost motion drive connector block 247 mounted for limited reciprocation between radial end walls 248 and 249 of a cavity 241 in punch drive cam 244 (FIG. 18A). The lower end 246 of cam drive rod 238 is threaded to piston 236 as best shown in FIG. 18B. Seal means 242 (FIG. 18A) is held in position in head blocks 232 by threaded bushing 286 (FIGS. 18A' and 18C) having a hexagonal opening 287 in its upper end used with a mating tool to rotate bushing 286 into position. Seal means 242 engages the outer surface of rod 238 to prevent pressure leakage from the rod side chamber 243 of punch cam drive cylinder 235; also, multi-purpose bore 250A (FIG. 18A) extends through head block 232 and has its lower end connected to rod side chamber 243 with its upper end being connected to the lower end of conduit 210A.

A cam guide block 250 (FIG. 16) is provided on the upper end of cam 244 and slidingly engages the bores 254 and 256, respectively, of housings 208 and 230. Guide block 250 assists the cam in maintaining alignment during movement in either direction and in preventing the cam from cocking or lifting up off of cam enclosing housings 208 and 230 during retraction of the punch.

Figure 4A:
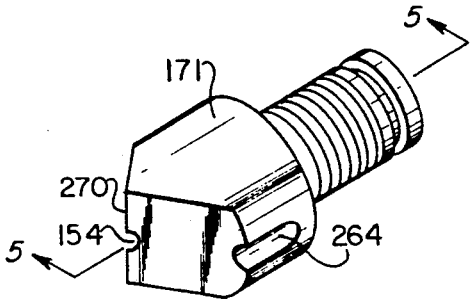
FIG. 4A is a perspective view of a preferred unitary punch/nozzle device used in practice of the invention.
Figure 5:
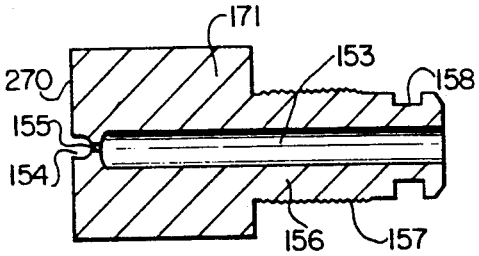
FIG. 5 is a sectional view taken along lines 5—5 of FIG. 4A.
Figure 6:
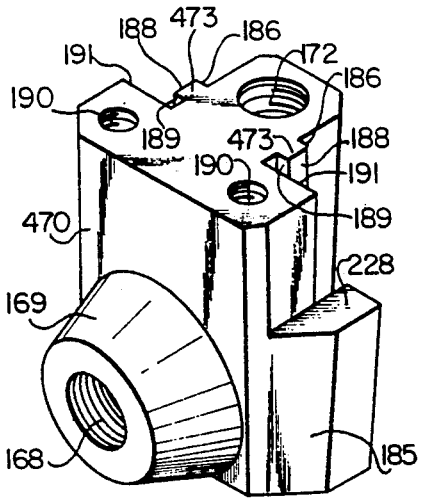
FIG. 6 is a perspective view of a cam follower and unitary punch/nozzle support base used for supporting the punch/nozzle device of FIG. 4A or the punch/nozzle device of FIG. 4B.

Punch means or member 171 of FIG. 4A is mounted in a threaded opening 168 (FIG. 6) in a cam follower 170(the details of which are also shown in FIGS. 36, 37, 38 and 39). The punch member 171 has a work fluid receiving bore 153 (FIG. 5) and a liquid jet emitting discharge opening 154 which are separated by a restrictive orifice provided at 155. A cylindrical mounting stub 156 having mounting threads 157 engageable with threaded opening 168 of a conical protrusion 169 of cam follower 170 and an annular seal receiving groove 158 defines the rear extent of punch 171 and is received in cam follower 170 as best shown in FIG. 16. An internal passage 172 (FIG. 16) in cam follower 170 communicates work fluid receiving bore 153 with a somewhat flexible stainless steel nozzle fluid supply conduit 162 which is connected by tubing fitting 164 (FIG. 16) on its lower end to passage 172 and by similar fitting 202D on its upper end to communicate with bore 196D, floating dowel 116D, bore 424D, etc. Fluid supply conduit is in a state of compression and is slightly bowed when cam follower 170 is in its retracted position of FIG. 16, but straightens and becomes less bowed as the cam follower moves to its extended position of FIG. 19A since such movement slightly increases the distance between upper fitting 163 and lower fitting 165 in which fitting the upper and lower ends of conduit 162 are respectively fixedly connected.

Punch member 171 extends through and is axially movable in an opening in a guide block 175 mounted in the lower cam enclosing housing 230 so that the punch member is capable of moving from its retracted position of FIG. 16 to its extended position of FIG. 19A. Movement of cam follower 170 is limited to radial movement relative to housing 230 by slide bearing surfaces on guide lug portions 229 of housing 230 engaging a cross bar 181 attached to cam follower 170 by bolts 193 received in threaded openings 190 provided in follower 170 and also engaging facing surface 227 of the cam follower and surfaces 228 of shoulders 183 and 185(FIG. 17) of cam follower 170.

Punch 171 includes diametrically opposite arcuate side slots 264 (only one of which is shown in FIG. 4A). The outer surface of the punch is hardened and it is machined so that a vertical cutting edge 270 is defined by the intersection of forwardly facing planar surfaces 268. Also, the forwardly facing planar punch surfaces 268 are oriented 450 from the horizontal axis and are therefore oriented at 90° with respect to each other.

Figure 4B:
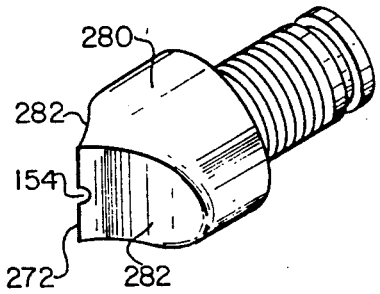
FIG. 4B is a perspective view of an alternative punch/nozzle device.

It would also be possible to use a punch such as punch 280 shown in FIG. 4B which has a side profile like that shown in FIG. 4 of U.S. Pat. No. 4,932,129. Punch 280 has curved forward surfaces 282 and does not have side slots; however, it is identical to punch 171 in all other respects. Curved forward surfaces 282 intersect to define a cutting edge 272 which is divided into two parts by discharge opening 154. FIGS. 32, 33, 34 and 35 illustrate a third punch embodiment 290 which could be used and which is identical to punch 280 with the exception of the fact that it employs a mounting stud which does not have a seal receiving annular groove such as groove 158 of punch 280.

Longitudinal force from the punch drive piston 236 and punch drive cam 244 is transmitted into radial force which acts on the cam follower 170 and punch 171 (or one of the other punch embodiments, if used) to effect punching of a hole in the well casing. The relatively moving contacting surfaces of housing 230, cam follower 170 and cam 144 are hardened to absorb the high pressures and forces to which they are subjected. Cam follower 170 includes hardened cam follower surfaces 186, 188, 189 and 191 which respectively engage facing hardened cam surfaces 220, 245, 251 and 284 (FIGS. 20 and 21) of cam 244 to extend or retract the punch 171 in response respectively to upward or downward movement of cam 244. Cam follower surfaces 186 and 189 are provided in parallel flanges 473 of the cam follower. The construction and interaction of the punch and cam 244, etc., is similar to that disclosed in U.S. Pat. No. 4,640,362 (Schellstede); however, the dovetail cam and follower contacting surfaces of the patent are eliminated by the present follower and cam so as to provide new and improved results.

More specifically, cam follower 170 and punch drive cam 244 are more economical to fabricate and operate with less friction than the corresponding members in U.S. Pat. No. 4,640,362, because the cam follower has parallel planar surfaces in place of the canted surfaces 293,294 of the cam follower of the patent engageable with facing planar surfaces of the punch drive cam 244 for effecting retraction of the punch member 171.

When the punch drive piston 236 is in its unactivated position shown in FIG. 18B, the cylindrical seal flange 274 is positioned in annular groove 237 of the annular face seal 234 on the bottom end surface 253 of piston 236; consequently, the pressure in upper reduced diameter bore 259 acts only on the surface portion 253' (FIG. 19B) of the end surface 253 of piston 236 within the confines of annular groove 237. The ratio of the area of the upper end surface 255 (FIG. 18B) of piston 236 radially outward of rod 238 to the area of surface portion 253' is 2.89 to 1.00 in the preferred embodiment. The purpose of the foregoing relationship is to preclude undesired extension of the punch during lowering of the tool in a deep well having high well bore pressure which is present in bore 259 and would act on the entire surface area 253 of the piston if it were not for the effect of seal means 234 and 274. Since the tubing pressure acts on the upper end surface 255 of the piston, the casing pressure acting on the entire surface 253 could cause shifting of the piston under such circumstances unless the tubing pressure was maintained at a higher level than the casing pressure. While maintaining the tubing pressure at a higher level would be possible, it would be time consuming and add to the overall cost of the operation.

However, the disclosed arrangement of seals 234 and 274 would require that the casing pressure be greater than 2.89 times the tubing pressure in order for the casing pressure to move the piston 236 upwardly; consequently, the operator need not do more than insure that the ratio of casing pressure to tubing pressure does not reach the critical value. Such result is achieved along with a safety factor by following a rule of thumb that the tubing pressure is increased whenever the casing pressure equals twice the tubing pressure so as to make the pressures approximately equal. It is consequently necessary to increase the tubing pressure only periodically after adding plural tubing sections rather than after the addition of each length of tubing as would otherwise possibly be necessary if seals 234 and 274 were not employed. Thus, substantial time savings and resultant economy are achieved.

A cycle of operation of the apparatus will now be discussed with reference being made to FIGS. 2A, 7A, 7B, 9A, 9B, 16, 17, 18A and 18B which illustrate the positions of the components prior to the initiation of casing penetration operation. The pressure from fluid in tubing section 26 acting downwardly on the valve spool 334 provides less force on the valve spool 334 than is necessary to overcome the bias of spring 312; punch drive piston 236 is consequently restricted to its lowermost position by the fluid pressure in rod side chamber 243 but is ready to move upwardly to initiate movement of punch drive cam 244 and the resultant movement of the punch member outwardly to begin the punching operation.

To start the operation, the pressure of the work fluid is increased to cause the downward force on valve spool 334 to exceed the upward force of spring 312. Such downward movement of valve spool 334 is initiated by increasing the pressure of work fluid in string 22 which fills the space in bore 310 of housing 302 and valve spool core 335 and acts on spool member 334 to urge it downwardly against the bias of spring 312. When the pressure of the work fluid reaches a predetermined value (the critical pressure), the force of spring 312 is overcome and valve spool 334 moves from its deactivated upper position in FIGS. 2A, 7A, etc., to its activated lower position of FIGS. 28, 8A, 8B, etc.

Positioning of valve spool 334 in its activated position causes work fluid to flow downwardly along path E comprising spool bore 335 (FIG. 8A), transverse bore 370 (FIG. 8B) annular chamber 372, lower central bore 407, annular chamber 410, radial bore 416C (FIG. 12), downwardly in axially parallel bore 414C, into radial bore 422C and then downwardly in bore 424C and into floating dowel 116C from which it flows into bore 196C (FIG. 17), tube fitting 202C, line 210C and hollow rod 212, bore 265(FIG. 19B), space 266, bores 263, bore 259 and finally into to head end chamber 258 for initiating upward movement of piston 236 to move lost motion drive connector block upwardly from its FIG. 18A position until its upper surface 247' contacts radial wall 248 at which time the driving force of the piston 236 is applied to the punch drive cam 244 to initiate upward cam movement.

Figure 28:
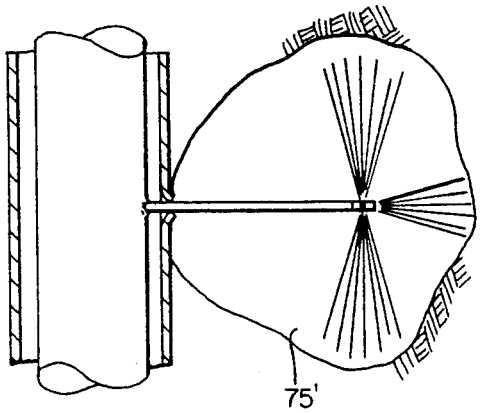
FIG. 28 is a side elevation view partially in section, of a casing and the surrounding formation illustrating usage of the nozzle of FIG. 26 in a second method of providing a cavity in the surrounding formation.

Exhaust fluid in rod side chamber 243 simultaneously flows upwardly along path R as shown in FIG. 28 consisting of flow through multi-purpose bore 250A (FIG. 18A) into conduit 210A, tube fitting 202A, bore 196A, floating dowel 116A(FIG. 17), axially parallel bore 424A (FIG. 8B), radial bore 422A, axially parallel bore 414A, upper radial bore 420A, annular chamber 409, upper central horizontal bore 405, movable chamber C1, upper radial bores 352, annular chamber 390 and exhaust bore 450 (FIG. 10) from which it exhausts to the exterior of the housing through check valve 454.

Figure 20:
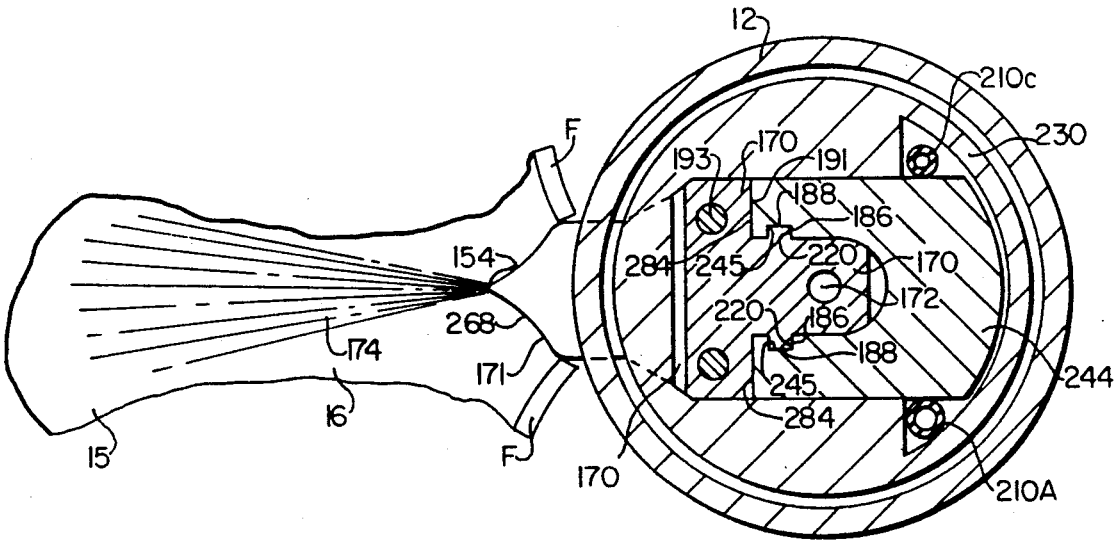
FIG. 20 is a sectional view taken along lines 20—20 of FIG. 19A.
Figure 21:
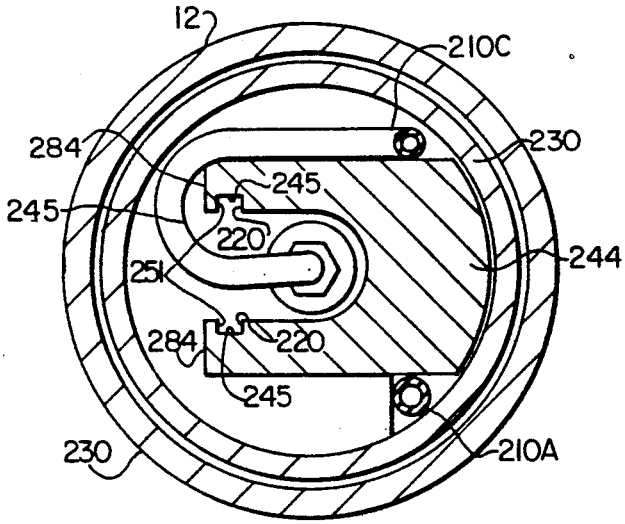
FIG. 21 is a sectional view taken along lines 21—21 of FIG. 19A.

The upward movement of the punch drive cam causes the cam to move the punch, which could be either punch 171 or punch 280, from its retracted lower position illustrated in FIG. 16 upwardly to its extended position illustrated in FIGS. 19A and 20 with such movement effecting the punching of a hole through casing 12 with the displaced portions of the casing comprising flaps F (FIG. 20) when punch 171 is used without there normally being any disconnection of any portion of the casing from the casing body. The movement of the punch from its retracted position of FIG. 16 results in a deflection of the lower end of conduit 162 as the punch moves to its extended position of FIG. 19A; such deflection and movement of the lower end of conduit 162 is permitted by the fact that conduit 162 is bowed and in a state of limited compression when the punch is in its retracted FIG. 16 position but straightens out and assumes' a more linear configuration during movement to the FIG. 19A position.

Figure 2A:
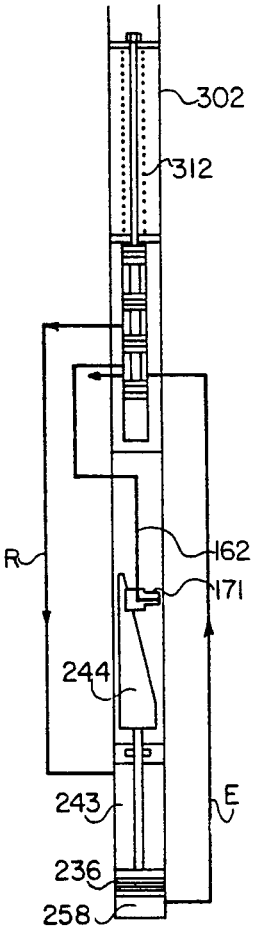
FIG. 2A is a schematic flow diagram illustrating the flow of control and work fluid flow paths in the apparatus used for penetrating the well casing and the surrounding formation as an initial step in practice of the invention with the parts being in the position assumed prior to initiation of the operation.
Figure 2B:
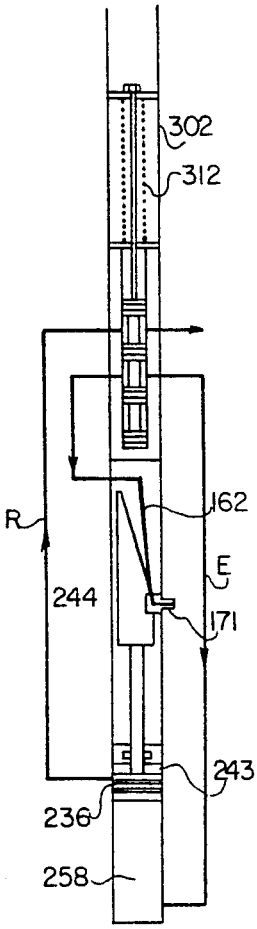
FIG. 2B is a view similar to FIG. 2A but illustrating the parts in the positions assumed during activation of the equipment.
Figure 3A:
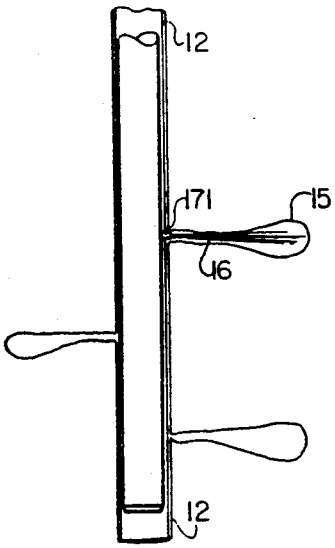
FIG. 3A and 3B are vertical section through a well casing illustrating the initial steps of forming plural cavities in the earth formation surrounding the casing in the practice of one aspect of the invention.

The positioning of the movable valve spool member 334 in its activated position of FIGS. 2B and 8B also causes the flow of work fluid through lower central bore 407 (FIG. 8B), upper radial bore 416D (FIG. 12), downwardly in axially parallel bore 414D (FIG. 9B), lower radial bore 422D, axially parallel bore 424D, floating dowel 116D (FIG. 16), bore 196D, tube fitting 202D, fluid supply conduit 162, passageway 172 of the cam follower and then into bore 153 of the punch from which it exists through the orifice at 154,155 as a high speed jet 174, as shown in FIG. 20. The action of the high speed jet initially causes the formation of bulbous shaped cavity 15 having a relatively narrow inner portion 16 in the surrounding formation as shown in FIG. 3A; however, prolonged application of the jet to the formation will result in a more bulbous cavity.

Upon completion of formation of the desired cavity, the fluid pressure in the string is reduced to permit the force of coil compression spring 312 to return the movable valve spool member 334 to the upper or retract position illustrated in FIGS. 2A, 7A and 7B.

The return of movable valve spool member 334 to the retract position illustrated in FIGS. 2A and 7A permits fluid to flow as shown in FIG. 7B through path R comprising bore 405, annular chamber 409, upper radial bore 420A, axially parallel bore 414A, lower radial bore 422A, axially parallel bore 424A, floating dowel 116A, bore 196A, tube fitting 202A, conduit 210A(FIG. 18A) and bore 250A to enter rod side chamber 243 to effect downward movement of piston 236 and cam 244 to retract punch 171 back into the housing to its FIG. 16 position. The fluid in chamber 258 of cylinder 235 is exhausted through bore 259, bores 263, space 266, bore 265, hollow rod 212, conduit 210C, flow connector 202C, bore 196C, floating dowel 116C, bore 424C (FIG. 7B), bore 422C, bore 414C, bore 416C, chamber 410, bore 407 and movable chamber C2 for discharge through, bore 411, chamber 412, bore 451 and check valve 456.

It sometimes occurs that it is difficult to retract the punch from its extended position. When this occurs, the lost motion drive connection 247 etc. permits a hammering effect to be applied to the cam so as to aid in jarring the punch to initiate movement; more specifically, the initial downward movement of rod 238 causes block 247 to move across cavity 241 from its position in which its upper surface 247' engages surface 248 to its lower position in which its bottom surface 247'' impacts radial wall 249. A series of hammer-like blows can consequently be applied to cam 244 by increasing and decreasing the pressure in the string above and below the critical pressure several times.

The cycle can be repeated a number of times to effect plural penetrations in the same producing zone of the formation in the manner shown in FIG. 3A. Following completion of all penetration operations, a weighted rod is dropped down the drill string to break a shear pin in circulating valve 21 to permit the tubing string to be drained of all fluid so as to reduce the amount of force required to lift the string and the penetration apparatus upwardly from the well casing and to eliminate pulling a "wet string" of tubing which would flood the well site.

Figure 3B:
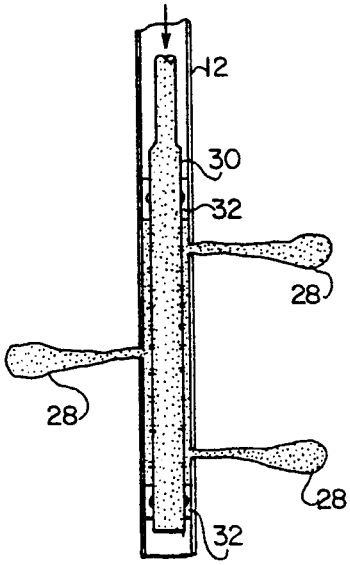
Figure 3C:
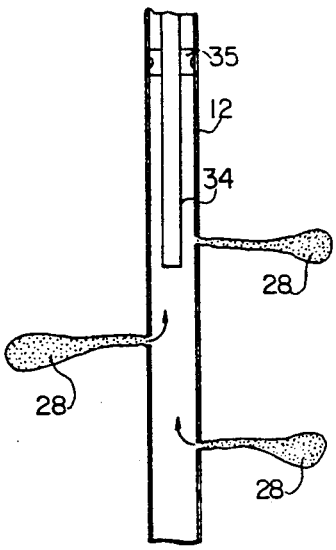
FIG. 3C is similar to FIGS. 3A and 3B but illustrates the operation of the producing well following completion of the step method steps of FIGS. 3A and 3B.

The bulbous shaped cavity provided by the inventive apparatus is of critical importance to the inventive gravel packing method, the first step of which is the provision of one or more bulbous shaped formation cavities following which the tool is removed from the well as discussed in the preceding paragraph. This technique is one of several ways that this type of penetration may be used in completing a well. A conventional gravel placement tool 30 is then lowered down the well and positioned adjacent the previously provided openings in the casing 12 and cavities 15 and seal means 32 on the upper and lower ends of the tool are activated to engage the inner surface of the casing 12 as shown in FIG. 3B. A conventional gravel slurry 28 consisting of gravel or other particles and a liquid binder such as epoxy, resin or other conventional binder mixtures or compounds is pumped down the string and forced out through the openings in the casing to fill the cavities 15. Gravel placement tool 30 is then removed from the well and the interior of the casing flushed with water or other liquid to remove the uncured gravel slurry from the casing. The binder in the gravel slurry in the cavities 15 cures after the passage of a given time period of a duration depending on the nature of the slurry binder constituent. A gravel screen 34 and production packer 35 are then positioned in the casing as shown in FIG. 3C and the well is in condition for the initiation of production flowing into the rigid gravel bodies in cavities 15 and thence into the interior of the casing.

All of the housing components are preferably made of 4140 alloy steel; punch members 171 and 280 are made of 4340 alloy steel and remaining metal components are stainless steel. However, it should be understood that other materials could be used.

Figure 22:
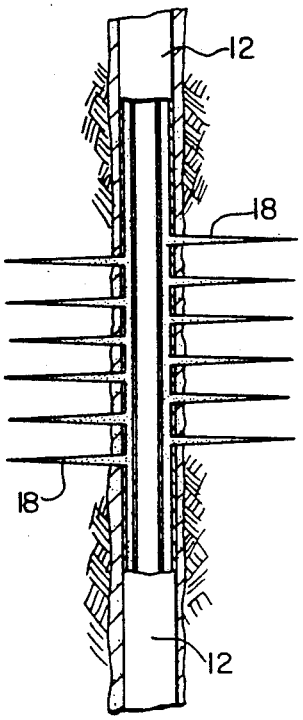
FIG. 22 PRIOR ART
FIG. 22 is a side elevation view partially in section of a well casing and the surrounding formation illustrating a conventional prior known method of gravel packing a formation.
Figure 23:
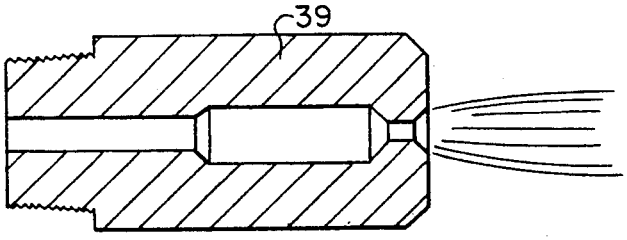
FIG. 23 is a bisecting sectional view of a nozzle employed in practice of a first inventive method of gravel packing a formation.
Figure 24:
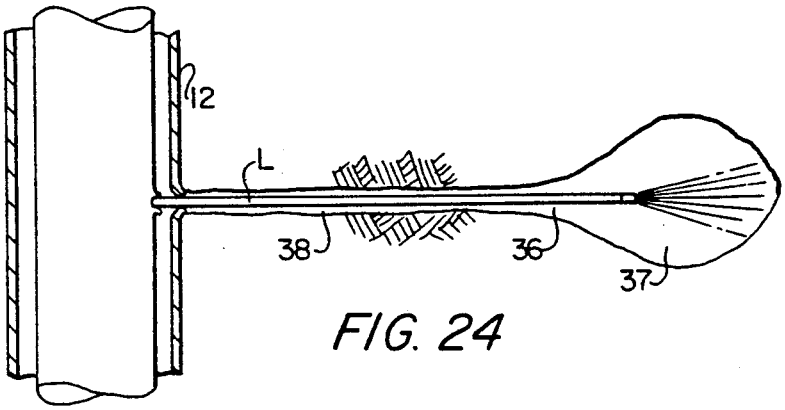
FIG. 24 is a side elevation view partially in section of a casing and the surrounding formation illustrating usage of the nozzle of FIG. 23 as the initial step in providing a cavity for receipt of gravel in a gravel packing operation.
Figure 29:
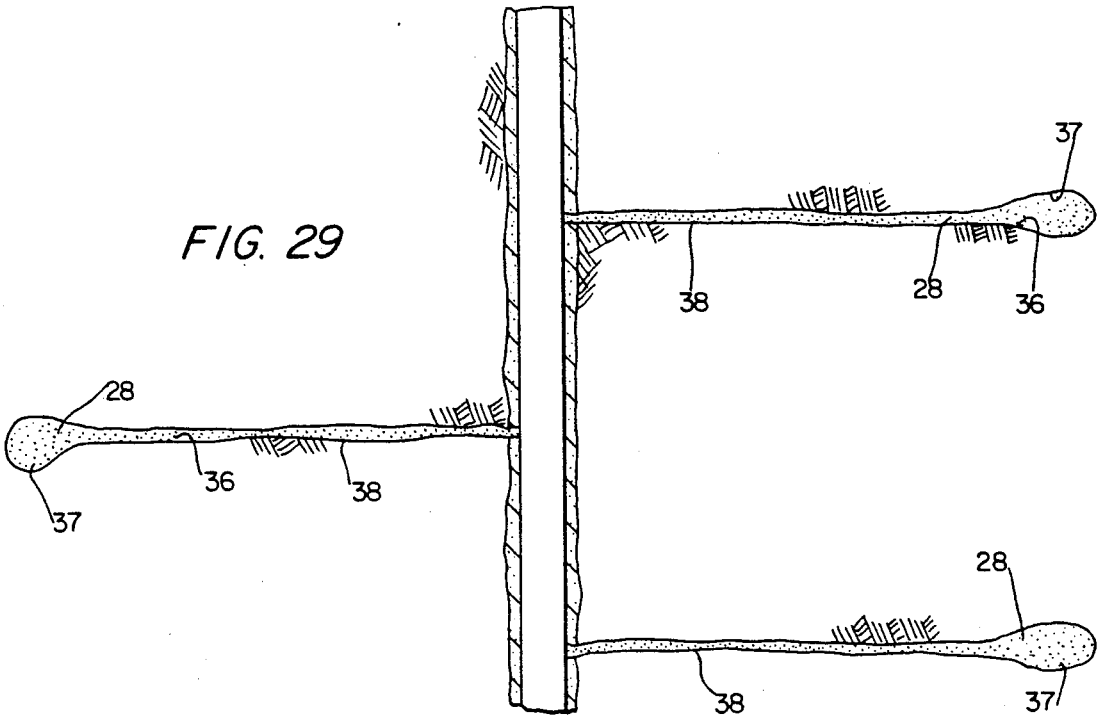
FIG. 29 is a side elevation view partially in section of a casing and the surrounding formation illustrating the gravel packing effected by use of the nozzles of either FIG. 23 or 25.
Figure 30:
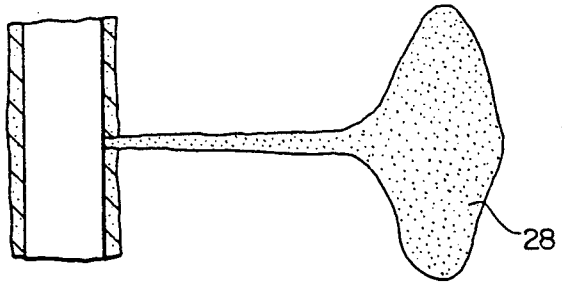
FIG. 30 is a side elevation view illustrating a casing and the surrounding formation following a gravel packing operation subsequent to the provision of the cavity in the manner shown in FIG. 27.
Figure 31:
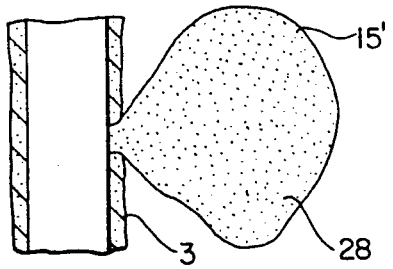
FIG. 31 is a side elevation view illustrating a section of a casing and the surrounding formation following a gravel packing operation subsequent to the provision of a cavity in the manner of FIG. 28.
Figure 32:
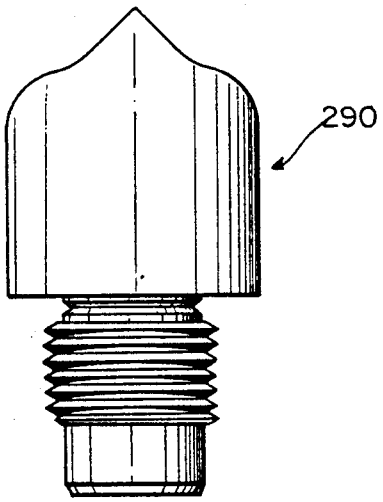
FIG. 32 is a side elevation view of a third nozzle/punch embodiment.
Figure 33:
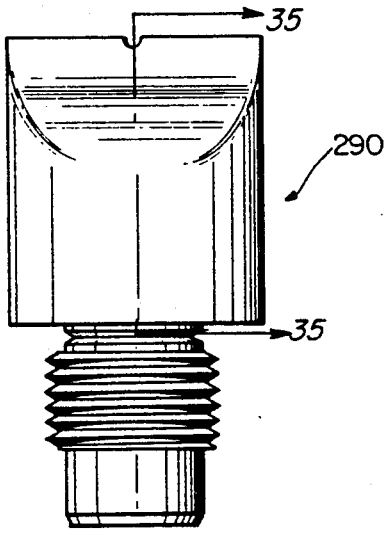
FIG. 33 is a front elevation view of the nozzle-punch of FIG. 32.
Figure 34:
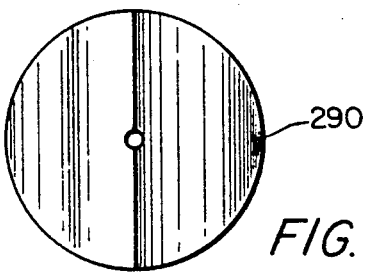
FIG. 34 is a top plan view of the nozzle/punch of FIG. 32.
Figure 35:
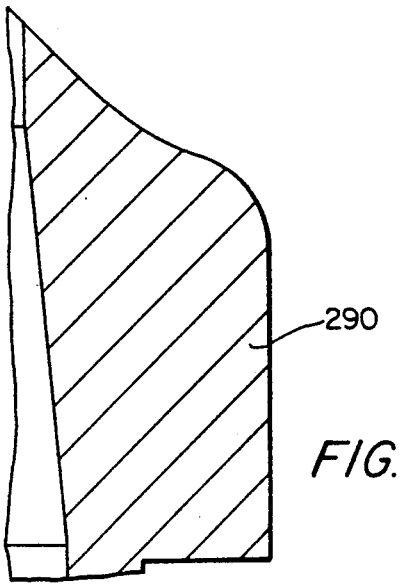
FIG. 35 is a bisecting sectional view of the nozzle/-punch of FIG. 32 illustrating the nozzle construction provided therein.
Figure 36:
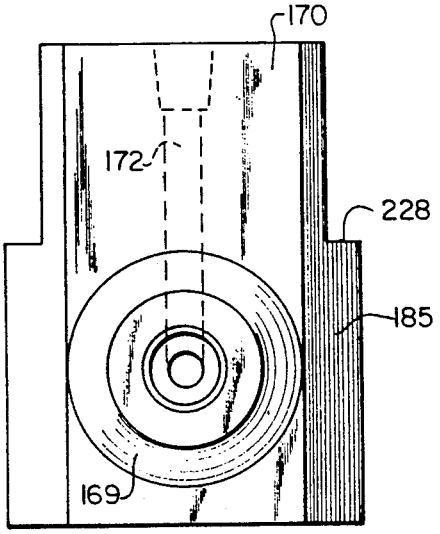
FIG. 36 is a front elevation view of the cam follower for effecting movement of the disclosed nozzle/punch embodiments of FIGS. 4A, 4B and 32.
Figure 37:
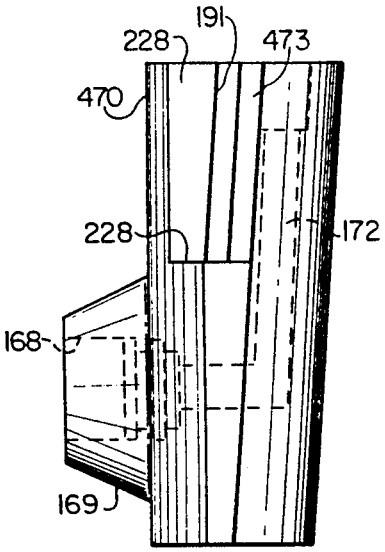
FIG. 37 is a side elevation view of the cam follower of FIG. 36.
Figure 39:
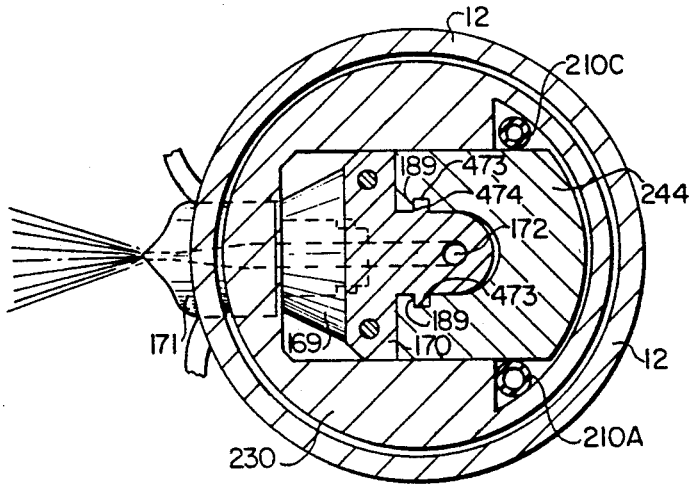
FIG. 39 is a bisecting transfer sectional view illustrating the cam follower of FIG. 36 in conjunction with a driving cam assembly.
Figure 38:
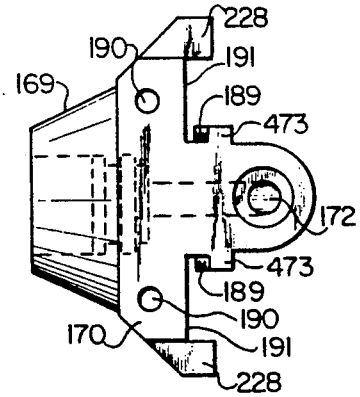
FIG. 38 is a top plan view of the cam follower of FIG. 36.

It should be understood that the use of the previously described nozzle-punch apparatus is not restricted to formation cutting for gravel packing operations and the apparatus can be used for a wide variety of purposes as was previously discussed in the summary of the invention. The practice of the gravel packing method can also be effected by the use of the well penetration apparatus disclosed in U.S. Pat. Nos. 4,640,362 and 4,928,757 in which a nozzle is mounted on the end of a hose or "lance" (means 206, 210 in the '362 patent and means 166, 169 in the '757 patent) which extends a substantial distance outwardly beyond the casing to create a cavity of greater length than is possible with the combination punch/nozzle of the preceding description. When the devices of the aforementioned patents employing the nozzles disclosed therein or a forwardly discharging nozzle such as nozzle block 39 of FIG. 23 are used to provide the cavities, the hose or "lance" L is permitted to dwell for a time period in its outermost position to create elongated cavities 36 having bulbous ends 37 and narrower inner portions 38. The cavities are formed by holding the nozzle in fixed extended position for a time period adequate to form the bulbous end shown in FIGS. 24 and 29 which can be filled with gravel packing 28 in exactly the same manner as previously described and illustrated in FIGS. 3A, 3B and 3C. A shorter lance than those shown in the aforementioned patents can be used in order to expedite the operation without any great detriment if desired. While the results achieved by the cavities as shown in FIGS. 24 and 29 are substantially better than the prior art results of FIG. 22, even better results are achievable by the use of the inventive side port nozzle 40 (FIGS. 25 and 26) in place of the nozzles disclosed in the aforementioned patents.

Side port nozzle 40 comprises a nozzle base 42 having a threaded end 44 connectable to the outer end of the lance of either the '362 patent or the '757 patent. Nozzle base 42 has a transverse end wall 46 in which an axial aperture 48 is provided to define an end of an axial bore or cylinder 50 extending axially from the left end of nozzle base 42 so as to define an inlet chamber 51. A piston 52 is mounted for movement in cylinder 50 and has a unitary rod 54 extending through an axial bore 48 in transverse end wall 46. An axial passageway 58 extends the length of piston 52 and rod 54 and a threaded surface 59 is provided on the exterior of rod 54 outwardly of a plurality of radial nozzle ports 56. A threaded nozzle body 60 is threaded onto threaded surface 59 and includes a radial end wall 61 in which an annular seal 68 is mounted in an annular groove. A flow chamber 62 in nozzle body 60 communicates with bore 58 and a flow restriction 64 defines a forwardly directed flow outlet from chamber 62 for the discharge of a forwardly directed high velocity jet 65 therefrom.

Figure 25:
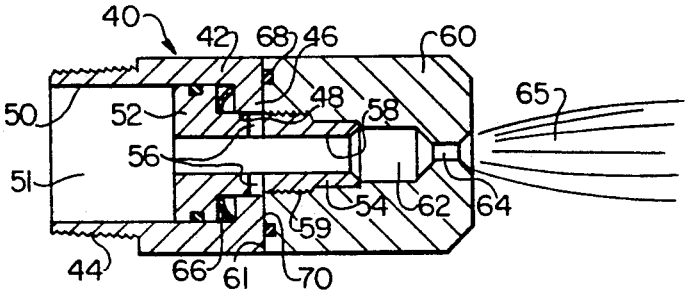
FIG. 25 is a bisecting sectional view of a unique nozzle employed for preparing the surrounding formation in a second method, preparatory to gravel packing of the formation.
Figure 26:
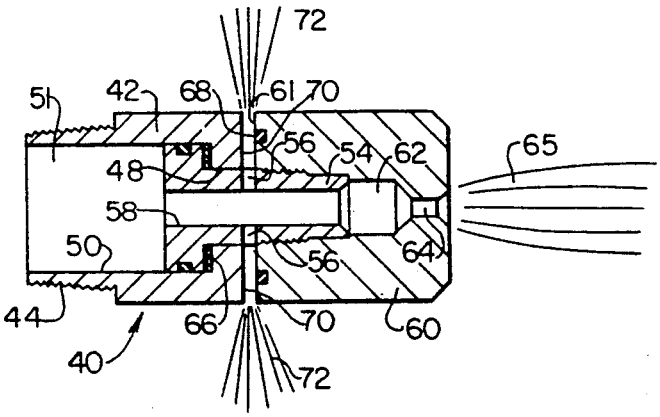
FIG. 26 is a bisecting sectional view of the nozzle employed in FIG. 25, illustrating the nozzle in a second mode of operation employed in providing a cavity in the surrounding formation in practice of the second method of gravel packing.

An annular spring 66 is positioned between piston 52 and end wall 46 so as to urge piston 52, rod 54 and nozzle body 60 to the left so that the parts are in the retracted position shown in FIG. 25. It should be observed that seal 68 is forcefully engaged with the radial end wall surface 70 of nozzle base 42 so as to preclude the discharge of work fluid from the radial nozzle ports 56. The parts remain in the FIG. 25 position as long as the pressure in cylinder 50 remains below the critical pressure at which the force exerted on piston 52 is sufficient to overcome the force of spring 66 and move the piston 52, rod 54 and nozzle body 60 to the extended position of FIG. 26 in which the radial nozzle port 56 are not blocked by seal 68 and high speed fluid jets 72 are consequently emitted from ports 56.

Figure 27:
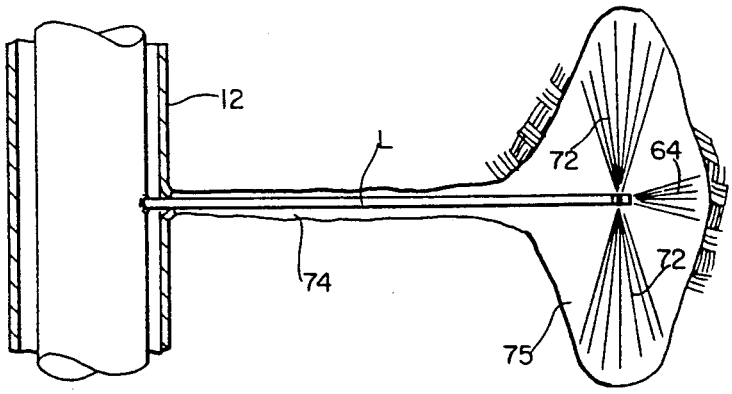
FIG. 27 is a side elevation view partially in section, illustrating a second step in the operation of the nozzle of FIG. 25 with the nozzle being operated in the manner shown in FIG. 26.

The side port nozzle is employed in the practice of one embodiment of the inventive method in a manner to be described with reference to FIG. 27. More specifically, after the casing has been punctured, the lance L having the side port nozzle assembly 40 on its outer end is extended with the internal pressure in the cylinder 50 being below the critical shift pressure so that the parts are in the retracted position and the forwardly directed jet 65 is the only jet emitted from the nozzle. A cavity portion 74 of reduced transverse dimension is formed as the lance moves outwardly from the casing 12; however, when the nozzle is positioned a desired distance from the casing 12, the work fluid pressure is increased to exceed the critical shift pressure and cause the parts to assume the FIG. 26 extended position with radial jets 72 being emitted to form a bulbous end portion as shown in FIG. 27. A more bulbous cavity 75 'can be formed as shown in FIG. 28 by reducing the extent of outward movement of the nozzle and increasing the duration of operation of the nozzle.

While several embodiments of the invention have been disclosed, it should be understood that the spirit and scope of the invention is not limited to the disclosed embodiments and should be determined solely by reference to the following claims.

We claim:

1. In a well penetrator of the type including housing means capable of being lowered down the interior of a well casing, a work fluid input means in said housing means, a movable punch member having an inner end and an outer end and being movable between a retracted position and an extended position, said outer end of said movable punch member including casing cutting means for cutting an opening in a casing when moved forcefully outwardly toward said extended position, punch support means supporting said punch member for movement relative to said housing means between said retracted position in which said outer end of said punch member is positioned substantially within the confines of said housing means and said extended position in which said outer end of said punch member is positioned outwardly of said housing means, power actuated punch drive means mounted in said housing means for selectively moving said punch member between its retracted and extended positions, first punch work fluid supply means connected to said punch drive means for activating said punch drive means to move the punch toward its retracted position, second punch work fluid supply means connected to said power actuated punch drive means for actuating said punch drive means to cause the punch to move toward its extended position, control valve means mounted in said housing means including a movable valve spool member mounted for movement between a first position in which said control valve means directs work fluid to said first punch work fluid supply means to cause said punch to move toward its retracted position and a second position in which said control valve means directs work fluid to said second punch work fluid supply means to position the punch in its extended position, said movable valve spool means having a portion contacted by work fluid from said work fluid input means so that the pressure of the work fluid urges said valve spool toward its second position, said punch having a fluid discharge opening in the outer end of said punch, a flow restriction nozzle adjacent the discharge opening fixedly positioned in said fluid passageway, nozzle fluid supply conduit means connecting said fluid passageway to said control valve means for providing high pressure work fluid to said passageway to cause a high speed fluid jet to be emitted forwardly from said flow restriction nozzle in response to positioning of said movable valve spool member to its second position, said nozzle fluid supply conduit means comprising a metal tube maintained in slightly bowed condition to permit movement of the punch to its extended position from its retracted condition without the creation of excessive force on said metal tube, and force exerting means for applying force to said movable valve spool member for moving said movable valve spool member toward its first position in response to the pressure of said work fluid in said work fluid input means being below a predetermined critical value so that said punch means is positioned in its retracted position and for permitting said movable valve member to move to its second position in response to the pressure of said work fluid in said work fluid input means exceeding said critical pressure.

2. A well penetrator as recited in claim 1 wherein said force exerting means comprises spring means.

3. A well penetrator as recited in claim 2 wherein said spring means comprises a coil compression spring.

4. A well penetrator as recited in claim 2 wherein said punch support means comprises a cam follower, said power actuated punch drive means comprises a vertically movable punch drive cam mounted for movement between an upper position which causes the punch to assume its extended position and a lower position which causes said punch to assume its retracted position, and cam follower means engageable with said punch drive cam, said punch drive cam including a first set of planar surfaces engageable with said cam follower for causing the cam follower to move the punch toward its extended position and a second set of planar surfaces oriented parallel to said first set of planar surfaces engageable with said cam follower for moving said punch toward its retracted position.

5. A well penetrator as recited in claim 4 wherein said power actuated punch drive means includes a hydraulic cylinder including a piston and piston rod assembly and lost motion drive means connecting said piston rod to said punch drive cam for permitting a hammering impact effect to be applied to said cam for aiding in the initiation of retracting movement of said punch member.

6. A well penetrator as recited in claim 1 wherein said punch support means comprises a cam follower, said power actuated punch drive means comprises a vertically movable punch drive cam mounted for movement between an upper position which causes the punch to assume its extended position and a lower position which causes said punch to assume its retracted position, and cam follower means engageable with said punch drive cam, said punch drive cam including a first set of planar surfaces engageable with said cam follower for causing the cam follower to move the punch toward its extended position and a second set of planar surfaces oriented parallel to said first set of planar surfaces engageable with said cam follower for moving said punch toward its retracted position.

7. A well penetrator as recited in claim 6 wherein said power actuated punch drive means includes a hydraulic cylinder including a piston and piston rod assembly and lost motion drive means connecting said piston rod to said punch drive cam for permitting a hammering impact effect to be applied to said cam for aiding in the initiation of retracting movement of said punch member.

8. A well penetrator as recited in claim 1 wherein said outer end of said punch member is defined by two planar surfaces which intersect to define a sharp edge in which said fluid discharge opening is positioned.

9. A well penetrator as recited in claim 8 wherein said punch support means comprises a cam follower, said power actuated punch drive means comprises a vertically movable punch drive cam mounted for movement between an upper position which causes the punch to assume its extended position and a lower position which causes said punch to assume its retracted position, and cam follower means engageable with said punch drive cam, said punch drive cam including a first set of planar surfaces engageable with said cam follower for causing the cam follower to move the punch toward its extended position and a second set of planar surfaces oriented parallel to said first set of planar surfaces engageable with said cam follower for moving said punch toward its retracted position.

10. A well penetrator as recited in claim 9 wherein said power actuated punch drive means includes a hydraulic cylinder including a piston and piston rod assembly and lost motion drive means connecting said piston rod to said punch drive cam for permitting a hammering impact effect to be applied to said cam for aiding in the initiation of retracting movement of said punch member.

11. A well penetrator as recited in claim 1 wherein said outer end of said punch member is defined by two curved surfaces which intersect to define a sharp edge in which said fluid discharge opening is positioned.

12. A well penetrator as recited in claim 11 wherein said punch support means comprises a cam follower, said power actuated punch drive means comprises a vertically movable punch drive cam mounted for movement between an upper position which causes the punch to assume its extended position and a lower position which causes said punch to assume its retracted position, and cam follower means engageable with said punch drive cam, said punch drive cam including a first set of planar surfaces engageable with said cam follower for causing the cam follower to move the punch toward its extended position and a second set of planar surfaces oriented parallel to said first set of planar surfaces engageable with said cam follower for moving said punch toward its retracted position.

13. A well penetrator as recited in claim 12 wherein said power actuated punch drive means includes a hydraulic cylinder including a piston and piston rod assembly and lost motion drive means connecting said piston rod to said punch drive cam for permitting a hammering impact effect to be applied to said cam for aiding in the initiation of retracting movement of said punch member.

14. A well penetrator as recited in claim 1 wherein said power actuated punch drive means includes a hydraulic cylinder including a piston and piston rod assembly, a head end portion of said hydraulic cylinder facing an end surface of said piston, said piston being movable between a retracted position in which said punch is in its retracted position and the end surface of said piston is closely spaced from and facing said head end portion of said hydraulic cylinder, a fluid flow passage extending through said head end portion of said hydraulic cylinder terminating in an opening facing said end surface of said piston and cooperating sealing means on said head end portion and said end surface of said piston and said head end portion of said hydraulic cylinder operable in response to said piston being in its retracted position for preventing pressure in said fluid flow passage from acting on portions of said end surface positioned radially outward of said sealing means so as to reduce the force on said piston caused by said pressure to less than what it would be if said pressure was acting on the entire end surface of said piston.

15. A well penetrator as recited in claim 14 wherein said punch support means comprises a cam follower, said power actuated punch means comprises a vertical movable punch drive cam mounted for movement between an upper position which causes the punch to assume its extended position and a lower position which causes said punch to assume its retracted position, and cam follower means engageable with said punch drive cam, said punch drive cam being connected to said piston rod so as to be moved by said piston rod between its upper and lower positions.

16. A well penetrator as recited in claim 15 wherein said power actuated punch drive means includes a lost motion drive means connecting said piston rod to said punch drive cam for permitting a hammering impact effect to be applied to said cam for aiding in the initiation of retracting movement of said punch.

17. A well penetrator as recited in claim 14 wherein said cooperating sealing means comprises an annular face seal formed of rubber or the like and a cylindrical seal flange formed of metal and positioned to engage said annular face seal when said piston is in its retracted position.

18. A well penetrator as recited in claim 17 wherein said annular face seal is mounted on said end surface of said piston and said cylindrical seal flange extends unitarily from said head end portion of said cylinder.

19. A well penetrator including housing means capable of being lowered down the interior of a well casing, a work fluid input means in said housing means, a movable punch member having an inner end and an outer end and being movable between a retracted position and an extended position, said outer end of said movable punch member including casing cutting means for cutting an opening in a casing when moved forcefully outwardly toward said extended position, punch support means supporting said punch member for movement relative to said housing means between said retracted position in which said outer end of said punch member is positioned substantially within the confines of said housing means and said extended position in which said outer end of said punch member is positioned outwardly of said housing means, power actuated punch drive means mounted in said housing means for selectively moving said punch member between its retracted and extended positions, first punch work fluid supply means connected to said punch drive means for activating said punch drive means to move the punch toward its retracted position, second punch work fluid supply means connected to said power actuated punch drive means for actuating said punch drive means to cause the punch to move toward its extended position, control valve means mounted in said housing means including a movable valve spool member mounted for movement between a first position in which said control valve means directs work fluid to said first punch work fluid supply means to cause said punch to move toward its retracted position and a second position in which said control valve means directs work fluid to said second punch work fluid supply means to position the punch in its extended position, said movable valve spool member having a portion contacted by work fluid from said work fluid input means so that the pressure of the work fluid urges said movable valve spool member toward its second position, said punch having a fluid discharge opening in the outer end of said punch, a flow restriction nozzle adjacent the discharge opening fixedly positioned in said fluid passageway, nozzle fluid supply conduit means connecting said fluid passageway to said control valve means for providing high pressure work fluid to said passageway to cause a high speed fluid jet to be emitted forwardly from said flow restriction nozzle in response to positioning of said movable valve spool member in its second position, said nozzle fluid supply conduit means including a tube fixedly connected on one end to connector means connected to said control valve means and connected on an opposite end to said punch support means for movement of said opposite end with said punch support means, said tube being maintained in slightly bowed condition when said punch is in its retracted position to permit movement of the punch to its extended position from its retracted condition without the creation of excessive force on said tube, and force exerting means for applying force to said movable valve spool member for moving said movable valve spool member toward its first position in response to the pressure of said work fluid in said work fluid input means being below a predetermined critical value so that said punch means is positioned in its retracted position and for permitting said movable valve member to move to its second position in response to the pressure of said work fluid in said work fluid input means exceeding said critical pressure.

20. A well penetrator as recited in claim 19 wherein said power actuated punch drive means includes a punch drive cam, a hydraulic cylinder including a piston and piston rod assembly and lost motion drive means connecting said piston rod to said punch drive cam for permitting a hammering impact effect to be applied to said cam for aiding in the initiation of retracting movement of said punch member.

21. A well penetrator as recited in claim 20 wherein said outer end of said punch member is defined by two planar surfaces which intersect to define a sharp edge in which said fluid discharge opening is positioned.

22. A well penetrator as recited in claim 19 wherein said outer end of said punch member is defined by two curved surfaces which intersect to define a sharp edge in which said fluid discharge opening is positioned.

23. A well penetrator as recited in claim 19 wherein said power actuated punch drive means includes a hydraulic cylinder including a piston and piston rod assembly, a head end portion of said hydraulic cylinder facing an end surface of said piston, said piston being movable between a retracted position in which said punch is in its retracted position and the end surface of said piston is closely spaced from and facing said head end portion of said hydraulic cylinder, a fluid flow passage extending through said head end portion of said hydraulic cylinder terminating in an opening facing said end surface of said piston and cooperating sealing means on said head end portion and said end surface of said piston and said head end portion of said hydraulic cylinder operable in response to said piston being in its retracted position for preventing pressure in said fluid flow passage from acting on portions of said end surface positioned radially outward of said sealing means so as to reduce the force on said piston caused by said pressure to less than what it would be if said pressure was acting on the entire end surface of said piston.

24. A well penetrator as recited in claim 23 wherein said punch support means comprises a cam follower, said power actuated punch drive means comprises a vertically movable punch drive cam mounted for movement between an upper position which causes the punch to assume its extended position and a lower position which causes said punch to assume its retracted position, said cam follower means being drivingly engaged with said punch drive cam, said punch drive cam being connected to said piston rod so as to be moved by said piston rod between its upper and lower positions.

25. A well penetrator as recited in claim 24 wherein said power actuated punch drive means includes a lost motion drive means connecting said piston rod to said punch drive cam for permitting a hammering impact effect to be applied to said cam for aiding in the initiation of retracting movement of said punch.

26. A hydraulic power means including a hydraulic cylinder including a piston and piston rod assembly, a head end portion of said hydraulic cylinder facing an end surface of said piston, said piston being movable between a first position in which the end surface of said piston is closely spaced from and facing said head end portion of said hydraulic cylinder and a second position in which the end surface of said piston is spaced away from said head end portion of said hydraulic cylinder, a source of fluid pressure for providing fluid pressure against said end surface of said piston and cooperating sealing means between said head end portion of said hydraulic cylinder and said end surface of said piston operable in response to said piston being in its first position for preventing said fluid pressure from acting on all of said end surface of said piston so as to reduce the force on said piston caused by said pressure to less than what it would be if said fluid pressure was acting on the entire end surface of said piston.

27. A hydraulic power means as recited in claim 26 wherein said cooperating sealing means comprises an annular face seal formed of rubber or the like and a cylindrical seal flange formed of rigid material and adapted to engage said annular face seal when said piston is in its first position.

28. A hydraulic power means as recited in claim 27 wherein said annular face seal is mounted on said end surface of said piston and said cylindrical seal flange extends unitarily from said head end portion or said cylinder.

29. A hydraulic power means as recited in claim 26 wherein said source of fluid pressure comprises flow passageway means in said head portion.

30. A hydraulic power means as recited in claim 29 wherein said cooperating sealing means comprises an annular face seal formed of rubber or the like and a cylindrical seal flange formed of rigid material and adapted to engage said annular face seal when said piston is in its first position.

31. A hydraulic power means as recited in claim 30 wherein said annular face seal is mounted on said end surface of said piston and said cylindrical seal flange extends unitarily from said head end portion of said cylinder.

32. A hydraulic power means as recited in claim 31 wherein said flow passageway means provides fluid pressure through an opening in said head end positioned within the confines of said cylindrical seal flange.

* * * * *